US007887003B2

(12) United States Patent
Maddaleni et al.

(10) Patent No.: US 7,887,003 B2
(45) Date of Patent: Feb. 15, 2011

(54) MACHINE AND METHOD FOR THE PRODUCTION OF ROLLS OF WEBLIKE MATERIAL TOGETHER WITH A WINDING CORE AND ROLL THUS OBTAINED

(75) Inventors: Romano Maddaleni, Pisa (IT); Angelo Benvenuti, Lucca (IT); Graziano Mazzaccherini, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 322 days.

(21) Appl. No.: 11/919,674

(22) PCT Filed: Apr. 27, 2006

(86) PCT No.: PCT/IT2006/000287

§ 371 (c)(1),
(2), (4) Date: Nov. 16, 2007

(87) PCT Pub. No.: WO2006/117820

PCT Pub. Date: Nov. 9, 2006

(65) Prior Publication Data

US 2008/0245923 A1 Oct. 9, 2008

(30) Foreign Application Priority Data

May 2, 2005 (IT) ..... F12005A0088

(51) Int. Cl.
*B65H 19/28* (2006.01)

(52) U.S. Cl. ..... 242/532.3; 242/535.1

(58) Field of Classification Search ..... 242/532, 242/532.1–532.3, 525, 527.2, 535.1, 541.2
See application file for complete search history.

(56) References Cited

U.S. PATENT DOCUMENTS

| | | | | |
|---|---|---|---|---|
| 3,013,367 | A * | 12/1961 | La Sarre | 53/520 |
| 3,150,575 | A | 9/1964 | Couzens et al. | |
| 3,220,320 | A | 11/1965 | Brigham | |
| 3,636,827 | A | 1/1972 | Lindberg | |
| 3,942,418 | A | 3/1976 | Smith | |
| 4,807,825 | A * | 2/1989 | Elsner et al. | 242/524 |
| 5,344,091 | A * | 9/1994 | Molison | 242/527.1 |
| 5,468,207 | A | 11/1995 | Bower et al. | |
| 5,873,806 | A | 2/1999 | Biagiotti | |
| 5,979,818 | A | 11/1999 | Perini et al. | |
| 6,394,385 | B1 | 5/2002 | Rhodes et al. | |
| 6,595,458 | B1 | 7/2003 | Biagiotti | |
| 2003/0116674 | A1 | 6/2003 | Sosalla et al. | |

FOREIGN PATENT DOCUMENTS

EP 0 639 520 A1 2/1995

* cited by examiner

*Primary Examiner*—Sang Kim
(74) *Attorney, Agent, or Firm*—Breiner & Breiner, LLC

(57) ABSTRACT

Described herein is a rewinding machine for the production of rolls (L) of weblike material around winding cores, including a path for the weblike material (N) and a winding area, in which said weblike material is wound in rolls. The machine moreover comprises a feeder for feeding a sheetlike material (F) towards the path of the weblike material, and forming members (13, 15) for rolling a length of said sheetlike material and forming therewith a winding core around which a roll of weblike material is formed.

50 Claims, 25 Drawing Sheets

37
B-B
N
C
50
47
41
F
Fc
45
M
108
109
E-E
111
43
39
FT
1
CC
5
7
D-D
L
A
M
4
3
A-A
103
105
101
107

7
5
L
A
3
205
1
A
213
F-F
FT
211
203
240
201
203A
C
39
N
fN
PN
C

MACHINE AND METHOD FOR THE PRODUCTION OF ROLLS OF WEBLIKE MATERIAL TOGETHER WITH A WINDING CORE AND ROLL THUS OBTAINED

TECHNICAL FIELD

The present invention relates to a device and a method for the production of rolls of weblike material such as paper, plastic, fabric, non-woven fabric, or the like.

More in particular, the invention relates to improvements to machines and methods for the production of rolls and also to the products thus obtained.

STATE OF THE ART

In the production of rolls of weblike material, for example rolls of toilet paper, rolls of kitchen towels, rolls of non-woven fabric, rolls of adhesive tape, plastic film, aluminum film or the like, tubes made of cardboard or other material are commonly used as winding cores, obtained by helical winding of at least two strips of weblike material glued together in such a way that they overlap and are staggered with respect to one another.

Helical winding of the strips is performed by machines referred to as core-winders, which have a forming spindle (which is fixed or supported idle about its own axis), around which the strips of weblike material are wound in a helix, at least one of said strips being previously provided with a layer of glue. Usually, winding is obtained via a winding member, typically an endless belt, which surrounds with a helical turn the spindle and brings about drawing and winding of the strips of weblike material. The winding member applies a thrust to the strips wound in a helix, to form the tubular product and causes it to advance along the winding spindle.

Examples of machines of this type are described in the U.S. Pat. Nos. 3,150,575; 3,220,320; 3,636,827; 3,942,418; 5,468,207; 5,873,806; 6,394,385.

The strips of weblike material are wound in a continuous way and form a continuous tube, which is then cut into pieces of the required length via cutting members arranged along the tube being formed.

In the lines for production of rolls of kitchen towels, toilet paper and in general of rolls of so-called tissue paper, the rolls or logs of wound paper are produced at very high rates. The winding time is in the range of 1-2 seconds per roll, with a rate of winding even higher than 1000 m/min. The tubes or winding cores must be fed to the converting line, and in particular to the rewinding machine, at a rate equal to that of production of the rolls or logs. In order to meet the high production rate, it is necessary to provide one or more core-winders alongside the main converting line. This entails drawbacks on account of the costs of the core-winders and of the encumbrance deriving from their arrangement at the sides of the main line.

Furthermore, the need to wind the strips of cardboard or other material around a forming spindle entails problems that are accentuated with the increase in the rate of production.

OBJECTS AND SUMMARY OF THE INVENTION

An object of the present invention is to overcome in all or in part the drawbacks referred to above.

Basically, according to a first aspect, the invention proposes a new method and a new rewinding machine that enable production of rolls of weblike material wound around a central core, but that do not require a core-winder or other machine for the production of the cores off the weblike material converting line, in which the rewinding machine is inserted.

According to an aspect of the present invention a method for the production of rolls of weblike material wound around winding cores is suggested, wherein the winding cores are formed by rolling lengths of a sheetlike material along a path for feed of the weblike material towards a winding area.

The winding method can be based upon a central winding system, with rotating centers or spindles that keep the roll in rotation. Preferably, however, the invention is implemented in a so-called peripheral or surface winding system, in which the roll being formed is kept in rotation as a result of the peripheral contact with winding members, such as rollers or belts.

Unlike traditional methods, then, in which the tubular cores are produced off the line in which the rewinding machine that forms the rolls is set by means of a purposely provided core-winder, according to a preferred embodiment the invention envisages that also the winding core will be formed on the line and at the same time as the start of formation of each roll.

This enables substantial reductions of cost and overall dimensions, there being reduced the need for setting core-winders alongside the main production line. Furthermore, since the winding core is produced directly on the line and does not have to be manipulated as semi-finished product, it can be made of a very light material. Typically, sheet materials can be used with a mass per unit area comprised between 50 and 200 g/m$^2$ and preferably between 80 and 120 g/m$^2$. According to another aspect, the mass per unit area of the sheetlike material can be comprised between 50 and 400 g/m$^2$ and preferably between 80 and 200 g/m$^2$. Also reduced is the need to glue the turns of cardboard that form the core. This enables a further substantial saving in the costs of production, but also advantages in terms of disposal. The sheetlike material that forms the winding core can in fact be recycled more easily, since it is made without glue. A sheetlike material that dissolves in water could also be used, such as the tissue paper forming the toilet-paper rolls. In this case, the winding core can be disposed of simply by throwing it into the toilet together with the toilet paper.

According to an embodiment of the invention, the method comprises the step of introducing a length of sheetlike material into a feed path of the weblike material to be wound. Preferably, this length of sheetlike material is rolled on itself, forming a winding core of the weblike material and around said core the roll of weblike material is formed.

In a possible embodiment, the sheetlike material is wound about an axis of winding oriented approximately at 90°, i.e., approximately in a direction transverse to a direction of feed of the weblike material along its feed path.

In order to facilitate start of winding of the weblike material around the new core formed by rolling of the length of sheetlike material on itself, in a preferred embodiment of the invention it is envisaged to join together the length of sheetlike material and the leading portion of the weblike material, formed by severing the weblike material at the end of winding of the previous roll.

The method is preferably a continuous-winding method, i.e., a method in which at the end of winding of a roll, feed of the weblike material is not interrupted, and preferably the rate of advance, i.e., the feed rate of the weblike material remains constant or approximately constant, even in the so-called exchange step, i.e. when the weblike material is interrupted and the leading portion thus formed starts to wind around a new winding core.

According to a possible embodiment of the method according to the invention, the following steps are envisaged:

(a) feeding the weblike material, advantageously at a substantially constant rate, into a winding area;

(b) forming a first roll;

(c) at the end of winding of the first roll, interrupting the weblike material to form a free trailing edge of said first roll and a free leading edge; and (d) feeding a length of sheetlike material into said winding area and rolling said length so as to form a winding core for a second roll associated to which is said free leading edge.

In order to control advance of the length or portion of sheetlike material that is to form the tubular core, according to an advantageous embodiment of the invention the length of sheetlike material is joined to the weblike material and made to advance together with said weblike material along a feeding path towards the winding area. The length of sheetlike material can be joined to the weblike material in the vicinity of the leading edge or of the tail edge of the length. Joining can be obtained by gluing, embossing, mechanical ply-bonding, possibly also with the use of ultrasound, or other suitable technique.

In an improved embodiment of the method, along the feeding path, the leading edge of the length of sheetlike material is deviated towards a forming member, which causes the sheetlike material to roll on itself to form the winding core. This effect of deviation, combined to the adhesion of the length of sheetlike material to the weblike material can be used for tearing the weblike material at a point corresponding to a perforation line and for generating the trailing edge of the roll being completed and the leading edge of the new roll, which adheres to the length of weblike material in order to start winding of the new roll.

In a possible embodiment of the method according to the invention, the length of sheetlike material is rolled around a forming spindle, for example a suction spindle, which is subsequently extracted from the roll of weblike material wound around said core. The forming spindle is advantageously inserted, for example, in the path for feed of the weblike material, adjacent to the weblike material.

In a modified embodiment, the length of sheetlike material is rolled within a space for the formation of the winding core. This empty space for the formation of the winding core is created along the path for feed of the weblike material and in a position adjacent to said weblike material at the moment when the winding core is being formed.

In a possible embodiment of the invention, it may be envisaged that the length of sheetlike material and the weblike material will be pressed against a feed member, for example a roller, which can also constitute a winding roller of the roll-winding system and around which the weblike material is entrained.

According to a different aspect, the invention relates to a rewinding machine for producing rolls of weblike material wound around winding cores. In a possible embodiment of the invention, the machine includes a path for the weblike material and a winding area in which said weblike material is wound in rolls, said rewinding machine being characterized in that it comprises a feeder for feeding the sheetlike material towards the path of the weblike material, and forming members, preferably arranged along the path for feed of the weblike material, for rolling up a length of said sheetlike material and forming therewith a winding core around which a roll of weblike material is formed.

According to a possible embodiment, the rewinding machine can include: a path for feed of the weblike material towards a winding unit; and a rolling member, for rolling up a length of sheetlike material to form a winding core. For example and preferably, the rolling member is set along the path for feed of the weblike material.

According to a possible embodiment, the machine includes a winding unit, for example a surface winding unit, to which the weblike material is fed, in said winding unit said weblike material being wound to form said rolls around said winding cores. Not excluded is the possibility of using a central winding system, or else a combined winding system, in which the roll is formed at least in part in contact with surface winding members, such as, for example, a set of winding rollers, preferably three winding rollers, and in which the winding cores are engaged by engagement members, which can, for example, be inserted within said cores and constitute a system for control of the position of the winding cores, or else also a system of transmission of a winding movement, possibly controlled via a servomotor, with a control unit that co-ordinates the movement of rotation of either one, the other or both of the engagement members and of one or more of the winding rollers or other surface winding members, such as belts or the like.

Preferably, the rewinding machine comprises a winding unit with a first winding roller, a second winding roller, and a third winding roller, in which two of said winding rollers form between them a nip, through which the weblike material is fed.

In an improved embodiment of the invention, the machine includes devices for causing the length of sheetlike material to adhere to the weblike material. These can be devices for gluing, mechanical ply-bonding, ultrasound welding, embossing or other equivalent means, also according to the nature and the mass per unit area of the materials used.

According to an advantageous embodiment of the machine according to the invention, the feeder of the sheetlike material for forming the winding cores can comprise a rotating roller. This can be set in front of a mobile member (for example a guide roller, a winding roller or the like), around which the weblike material is entrained, the path of the weblike material extending between said rotating roller and said mobile member. Advantageously, it may in this case be envisaged that the rotating roller is mobile to move up to the weblike material and pinch the sheetlike material against the weblike material run over said mobile member. In this way, the length of weblike material is accelerated up at the rate of feed of the weblike material and can advance with it towards the area of formation of the tubular winding cores. The sheetlike material can already be cut into lengths and the individual lengths fed into the rewinding machine, or else can be in the form of a continuous sheet perforated along perforation and tearing lines. The individual lengths are in this case formed, for example, by pulling the initial flap of the sheetlike material. The tensile force can be obtained by pinching the sheetlike material between the guide member of the weblike material and said rotating roller.

According to an advantageous embodiment, the forming members include means for deviating the leading edge of the length of sheetlike material along a rolling path.

The above forming members can include a forming spindle around which the length of sheetlike material is wound. The deviation of the leading edge around the spindle can be facilitated by using a suction spindle. Alternatively, it is possible to use electrostatic systems for electrically charging the spindle or the sheetlike material or both with charges of opposite sign.

Instead of a forming spindle it may be envisaged that the forming members comprise a space for the formation of the winding core, within which said length of sheetlike material is inserted and rolled and from which the rolled sheetlike material comes out to advance with the weblike material that winds around the rolled sheetlike material.

According to a possible embodiment of the invention, the formation space is defined by a fixed element and by a mobile element, which have complementary concave surfaces and are to be brought into opposed positions for delimiting said formation space. According to another embodiment, the space for the formation of the tubular cores can be formed by a first element and by a second element, both mobile and preferably both provided with a concave surface, the concave surfaces of the two elements being opposed to one another in the step in which they form, i.e., delimit, the space for formation of the tubular core.

The formation space can advantageously be defined adjacent to a mobile member over which the weblike material is run (for example, a guide roller or a winding roller), and is designed and arranged to receive the leading edge of the length of sheetlike material fed with said weblike material.

Advantageously, it may be envisaged that the mobile element rotates about an axis of rotation, with an intermittent, or continuous, or possibly alternating motion. In an advantageous embodiment of the machine according to the invention, the axis of rotation of the mobile element can coincide with the axis of rotation of a winding roller of a surface winding cradle for the formation of said rolls. In a preferred embodiment of the invention, the mobile element also has the function of interrupting the weblike material at the end of winding of each roll.

In a possible embodiment, the space for the formation of the cores is associated with two members, which are mobile in opposite directions and between which the path of the weblike material develops. For example, the space for the formation of the cores can be set near or in a position corresponding to said two mobile members, in such a way that the formed core that comes out of the formation space advances as a result of the contact with the mobile members.

According to a further aspect, the invention relates to a roll of weblike material, comprising a winding core, characterized in that said winding core is formed by turns of a rolled sheetlike material, said turns being oriented substantially at 90° with respect to the axis of the roll. In other words, the winding core is formed by turns that are not inclined in a helix with respect to the axis of the roll. Advantageously, moreover, said turns are preferably not glued together. Furthermore, the core is preferably formed by a single length of sheetlike material of a width equal to the axial length of the roll.

According to a further development of the invention, the rewinding machine and the winding method according to the present invention can be provided for winding approximately simultaneously a number of strips of weblike material obtained by longitudinally cutting a single ply or sheet of weblike material. These strips form in parallel rolls wound around a single winding core, or else around individual portions of rolled sheetlike material to form individual winding cores, each having a length approximately corresponding to (i.e., slightly smaller than or slightly larger than) the width of the respective strip that winds thereon. If the strips are wound on a single core, this can be formed by a single sheet perforated along perforation lines parallel to the direction of winding, so that the tubular core can then be broken easily in a position corresponding to the perforation lines, which in turn correspond to the area of separation between one roll and the adjacent roll formed with two adjacent strips of wound weblike material.

The invention also envisages a method for forming rolls of weblike material around winding cores, wherein, along a path for feed of the weblike material, a winding core is formed starting from a length of sheetlike material and wherein, around said winding core, the weblike material is wound to form the roll. For this purpose, according to a possible aspect, the invention envisages a rewinding machine, preferably of the type comprising a winding cradle with two or more winding rollers, with a path for feed of the weblike material, wherein along said weblike material path core-forming members are provided, which form winding cores, said forming members releasing each winding core along the path for feed of the weblike material in order to wind the respective roll around said core.

BRIEF DESCRIPTION OF THE DRAWINGS

The invention will be better understood referring to the following description and the attached drawing, which shows some non-limiting embodiments of the invention. More in particular, in the drawing.

DETAILED DESCRIPTION OF EMBODIMENTS OF THE INVENTION

Figure 1A:
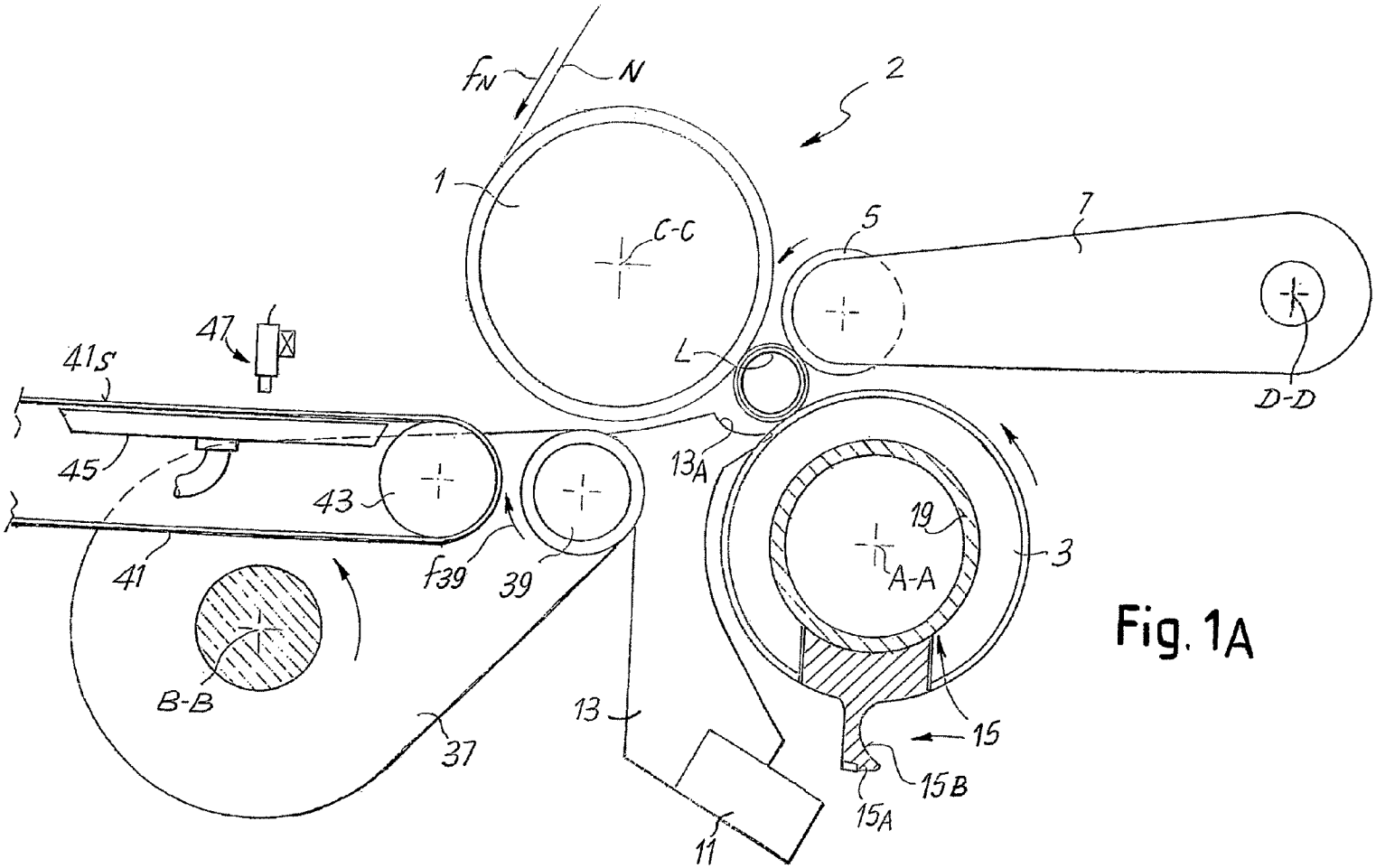
FIGS. 1A to 1G show an operating sequence of a rewinding machine according to the invention in a first embodiment.

With reference to FIGS. 1A to 1G, 2, 3 and 4, a first embodiment of the rewinding machine according to the invention will initially be described. FIGS. 1A to 1G show the winding head of the rewinding machine in three steps of a complete winding cycle.

The rewinding machine basically comprises a path for a weblike material N that is fed in the direction indicated by the arrow fN at a substantially constant speed. Arranged along the path of the material N is a perforator (not shown) as well as other return members, guide members, widening rollers or similar members (not shown either). The winding system (designated as a whole by 2) of the rewinding machine includes a first winding roller 1, a second winding roller 3, and a third winding roller 5. The directions of rotation of the three rollers 1, 3, 5 are indicated by the respective arrows.

The first winding roller 1 rotates with a substantially constant peripheral velocity corresponding to the rate of feed of the weblike material N. The first winding roller 1 forms with the winding roller 3 a nip through which the weblike material passes. The third winding roller 5 is supported by a pair of oscillating arms 7, which control the movement of gradual raising of the roller 5 to enable controlled growth of the roll during its formation in the winding cradle formed by the set of three rollers 1, 3, 5. The winding system, so-called surface or peripheral winding system, based upon the use of these three rotating members is known per se and does not require any more detailed description herein.

Carried on a fixed structure 11 is a set of shaped plates 13, which are aligned with respect to one another in a direction transverse to the weblike material N, and only one of which can be seen in FIGS. 1A to 1G. The plates 13 have a curved surface 13A arranged in the proximity of the nip between the winding rollers 1 and 3, which has the function of defining a rolling space for winding on itself a sheet or a length of sheetlike material that is to form the central core on which each roll is wound. Basically, the plates 13 with the curved surfaces 13A form a first forming member for on-line winding of the tubular cores on which the rolls are wound.

The rolling space for the formation of the tubular winding cores is defined not only by the curved surfaces 13A of the plates 13, but also by a mobile element designated as a whole by 15, which preferably—according to what is illustrated in the example of the drawing—rotates about the axis A-A of the second winding roller 3 or about an axis substantially parallel to the axis A-A. The rotating element 15 has radially projecting portions 15A, which define concave surfaces 15B, which, together with the surfaces 13A, delimit the space for winding of the tubular cores. The portions 15A and the plates 13 are arranged in an alternated way so that each portion 15A can move between two adjacent plates 13.

The rotating element 15 moves according to an intermittent motion of rotation in the direction indicated by the arrow f15 (FIG. 1D), which is opposite to the direction of rotation of the winding roller 3 (arrow f3).

Figure 4:
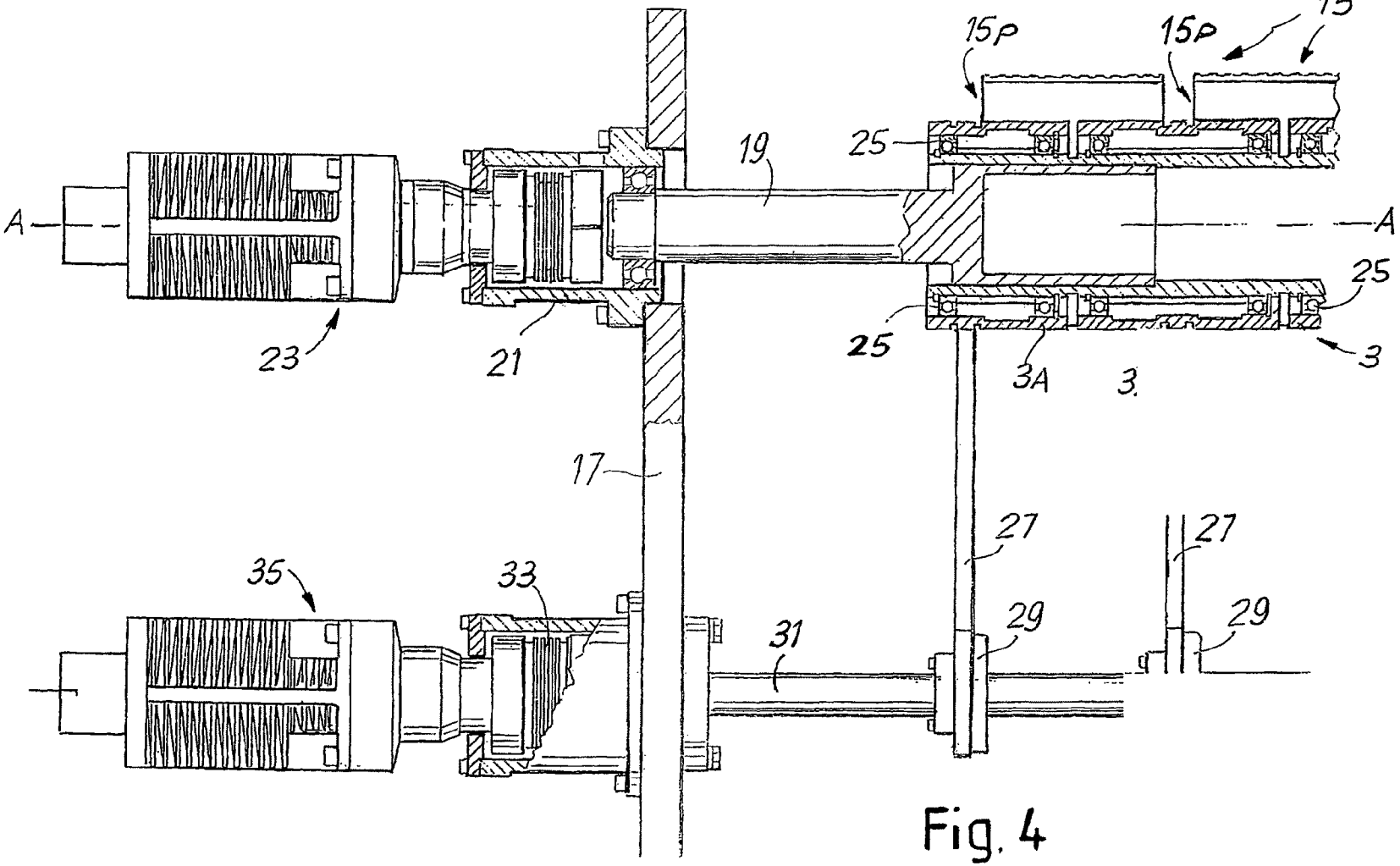
FIG. 4 shows a cross section of the bottom winding roller of the rewinding machine of FIGS. 1A to 1G with the corresponding motor members.

Transmission of the motion to the winding roller 3 and to the rotating element 15 is obtained, for example, with a configuration of the type shown in FIG. 4. Supported on a side 17 of the rewinding machine is a shaft 19 connected via a joint 21 to an electronically controlled motor 23. The shaft 19 carries fitted thereon individual portions 15P of the rotating element 15. Basically, therefore, the rotating element 15 is formed by a number of parts which are aligned to one another along the axis of the shaft 19 and distanced from one another. The motor 23 thus drives the element 15 in rotation according to the desired law (described hereinafter). The roller 3 is made up of a plurality of individual portions 3A, each of which is idly supported on the shaft 19 via bearings 25. A belt 27 for each portion of the roller 3 receives the motion from a respective pulley 29 fitted on a shaft 31, which is coupled, by means of a joint 33, to a motor 35. The latter can thus turn the roller 3 formed by the portions 3A at a speed that differs from and in a direction opposite to that of the rotating element 15 formed by the portions 15P.

The motors 23, 35 can also be equipped with reducers and, on machines provided with belt drive, not excluded is the possibility of using a pulley driven by said drive instead of the motor 35.

The rewinding machine further comprises a pair of oscillating arms 37, which support a roller 39 kept in constant rotation (arrow f39) at a peripheral velocity substantially equal to the peripheral velocity of the winding roller 1 and hence to the rate of feed of the weblike material N. The movement of the arms 37 can be controlled, for example, by an appropriately shaped cam (not shown), driven by an electronically controlled electric motor. The roller 39 can oscillate under the control of the arms 37 about an axis B-B parallel to the axis A-A of the winding roller 3 as well as to the axes of rotation C-C of the roller 1 and D-D of the arms 7 that support the roller 5. The motors or actuators that control oscillation of the arms 37 and rotation of the roller 39 are not shown in the figure.

Set between the two oscillating arms 37 is a conveyor belt 41 run over a pair of rollers, one of which is designated by 43 in the figures. Set underneath the top branch 41S of the conveyor belt 41 is a suction chamber 45, the top surface of which is provided with suction holes that suck through openings provided in the conveyor 41S. Alternatively, the latter can be constituted by a set of parallel belts and the suction chamber 45 can suck through the free space between one belt and the next.

Set on top of the conveyor belt 41 is a set of glue nozzles 47 aligned to one another in a direction orthogonal to the plane of FIGS. 1A to 1G, i.e., parallel to the axes of the rollers 1, 3, 5, 39.

The rewinding machine forming the subject of the present invention operates in the way described in what follows. Shown in FIG. 1A is the initial step of winding of a roll or log L around a winding core that has already been formed. The weblike material N advances along the feed path, guided around the winding roller 1, and winds in turns to form a log or roll L in the winding cradle defined by the rollers 1, 3 and 5. The roller 39 is located at a certain distance from the surface of the winding roller 1 so as not to touch the weblike material N and turns at a peripheral velocity equal at the rate of feed of the material N itself. The rotating element 15 is temporarily stationary with the laterally projecting portion 15A defining the concave surface 15B oriented downwards.

Figure 1B:
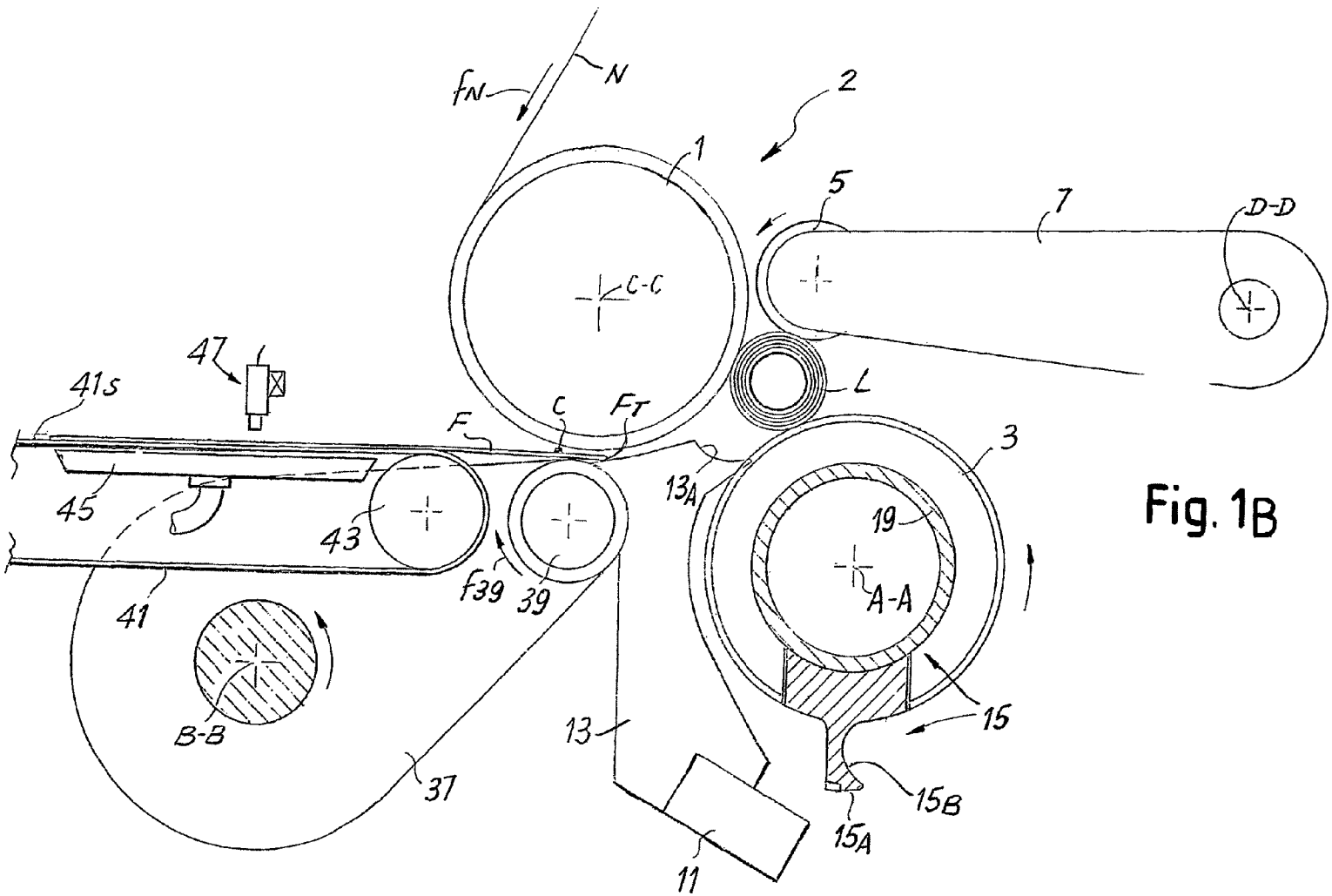

FIG. 1B shows a subsequent step, in which the log or roll L has increased in diameter in the winding cradle, and the winding roller 5 has been raised. The conveyor belt 41 has brought into the position illustrated a length F of a sheetlike material, for example, a Bristol board of adequate mass per unit area, comprised indicatively for example between 50 and 400 g/m$^2$ and preferably between 80 and 200 g/m$^2$. As an alternative to the Bristol board, the sheet or length of sheetlike material F can be made of a paper having a mass per unit area and characteristics such as to enable disposal thereof in a sanitary discharge such as a toilet, i.e. together with the tissue paper that forms the wound roll, in the case where said roll is a roll of toilet paper. It is known that the tissue paper to be used as toilet paper is characterized by a low content or the absence of so-called moisture-resistant resins, i.e., of those resins that bestow upon to the cellulose fibers forming the film of paper a temporary adequate resistance to water. The absence of moisture-resistant resins renders the paper easily soluble in water, i.e. water-soluble, in the sense that the fibers that make it up separate entering into suspension in the water in the form of individual fibers or of small fibers agglomerates. In tissue papers designed for other uses, typically paper wipes, a higher presence of moisture-resistant resins is found, in so far as this type of paper must have a greater resistance, at least a temporary resistance, to moisture given the type of use to which they are put.

With the present invention a sheet F of water-soluble paper in the sense defined above, i.e. readily dispersible in water as a result of the absence or of a low presence of moisture-resistant resins, can be used so that (especially in the case of toilet paper) the entire paper product that makes up the roll can be disposed of in the toilet discharge.

In the proximity of the leading edge FT of the length of sheetlike material F, the nozzles 47 have applied to them a glue C. Instead of nozzles 47 different systems for application of the glue, for example mobile buffers, rollers, brushes, or the like can be used. When the speed of production and the width of the machine allows for a single transversely movable nozzle, this can also be used to apply a line of glue on the width of the piece F of sheetlike material.

In the arrangement of FIG. 1B, the rotating element 15 is still stationary. The length of sheet material F is withheld, as a result of the suction exerted by the suction chamber 45, so as not to be drawn forwards, notwithstanding the contact of its leading edge with the rotating roller 39.

Figure 1C:
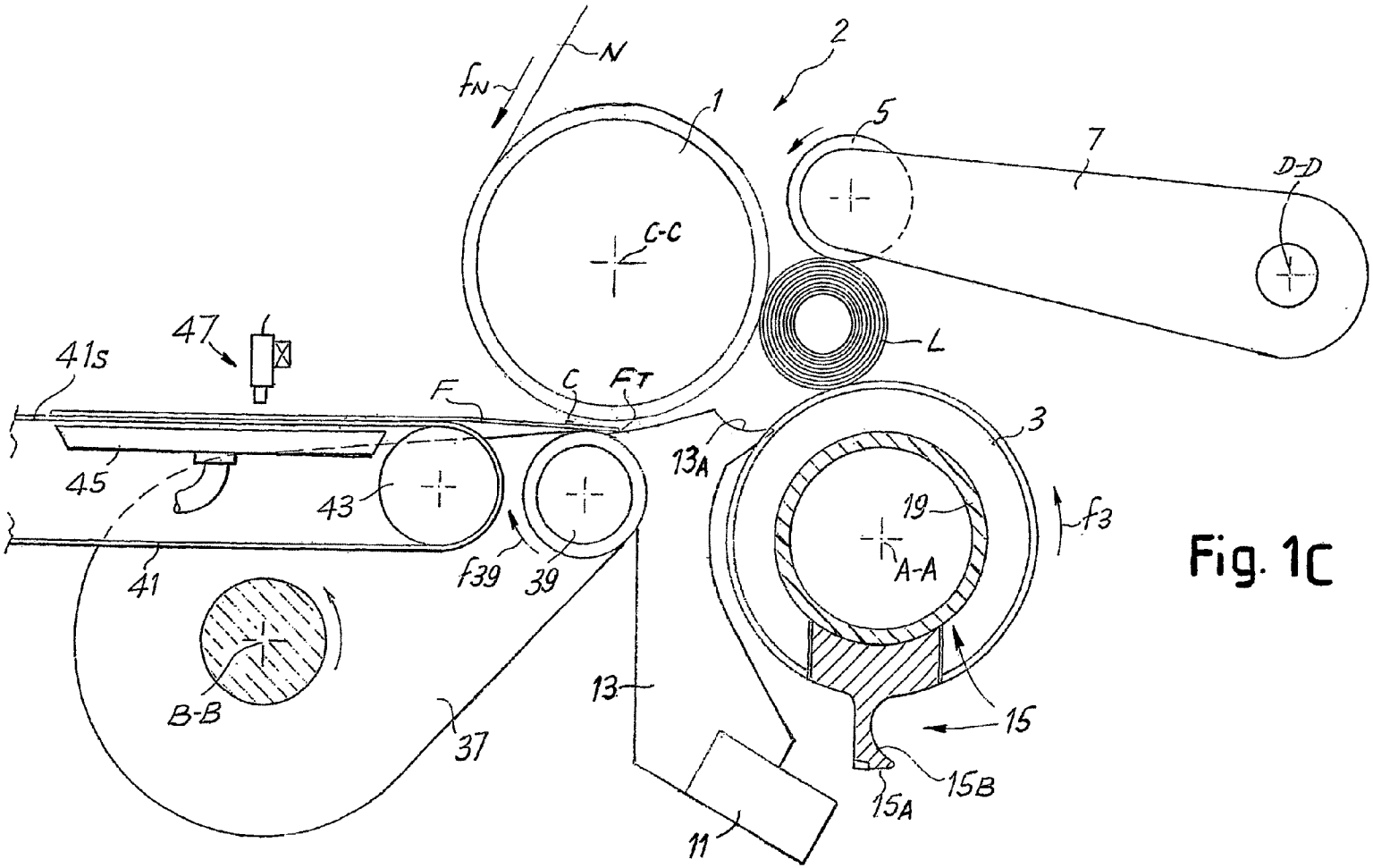

In FIG. 1C the length F of the sheetlike material is still in the position of FIG. 1B, and the rotating element 15 is still stationary, whilst the roll or log L has further grown in diameter.

Figure 1D:
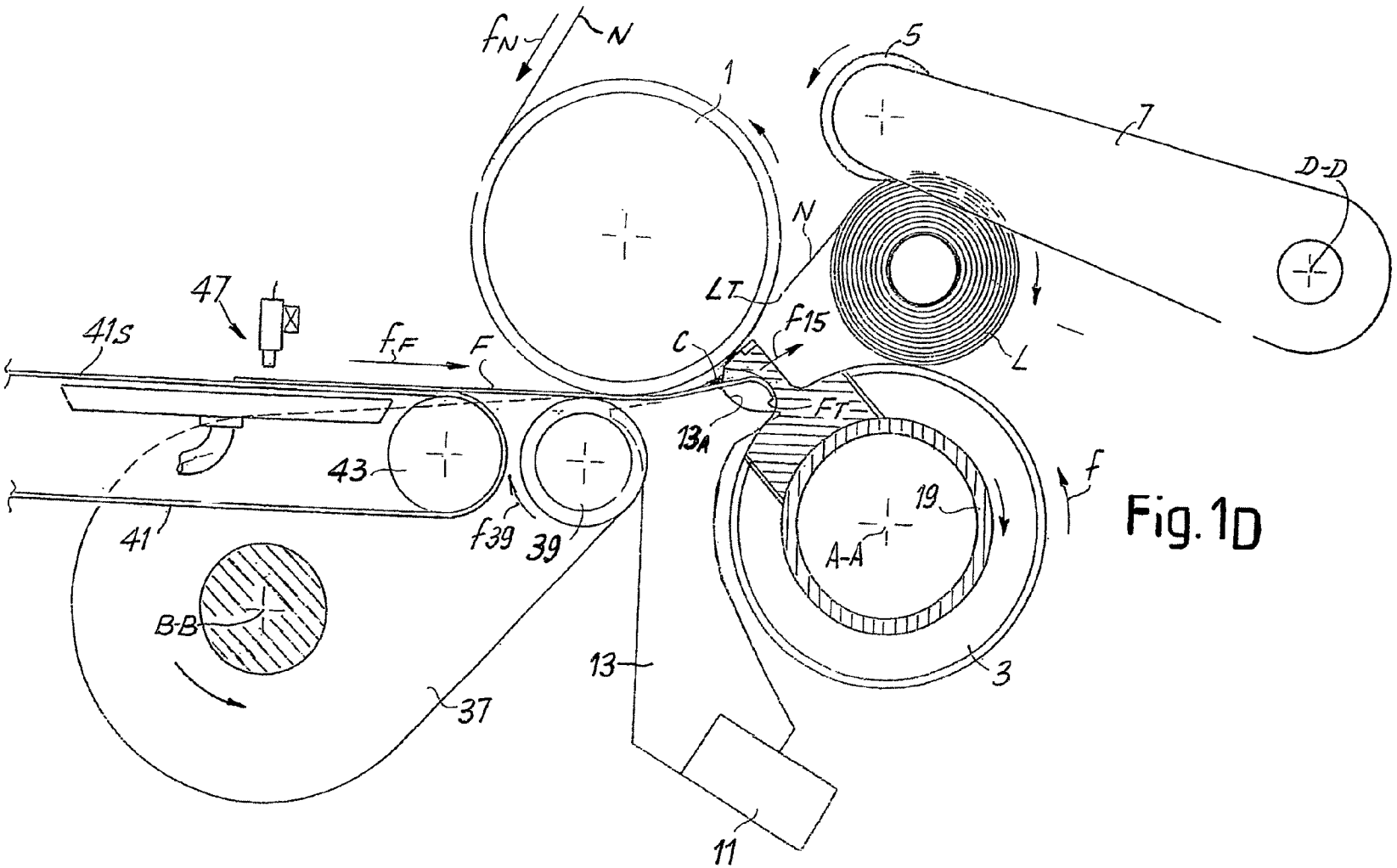

FIG. 1D illustrates an instant of the exchange phase, i.e. the phase where the complete log L is discharged and winding of the subsequent roll starts. The rotating element 15 has started to turn in the direction indicated by the arrow f15 (in a clockwise direction in the drawing) at a speed such that the peripheral velocity of the radially outermost portion 15A of the element 15 is lower than (for example 2-30% or, in particular, 10-20% of) the rate of feed of the weblike material N. As may be noted in FIG. 1D, the front surface of the radially outermost portion 15A of the rotating element 15 is sized so as to pinch the weblike material between said surface and the surface of the winding roller 1. Since the speed of the surface of the element 15 that comes into in contact with the weblike material N is lower than the speed of the winding roller 1, the weblike material N in the pinching area is slowed down and slides on the surface of the winding roller 1. Instead, the weblike material N already wound around the roll or log L continues to advance at the speed of winding, or even at a higher speed as a result of the possible temporary acceleration of the top winding roller 5. This difference in speed brings about tearing of the weblike material in an area comprised between the formed roll or log L and the pinching point between the winding roller 1 and the rotating element 15. Alternatively, it may also be envisaged that tearing, cutting or interruption of the weblike material may occur merely by acceleration of the winding roller with mobile axis 5 or in any other suitable way.

Designated by LT in FIG. 1D is the trailing edge or final edge of the weblike material N wound on the completed log L. The latter has started its discharge movement from the winding cradle in the direction indicated by the arrow fL. Discharge of the log is obtained as a result of the difference of peripheral velocity between the roller 5 and the roller 3 owing to the acceleration of the roller 5 and/or to the deceleration of the roller 3. It must be understood that according to the configuration of the machine, not necessarily both of the rollers 3 and 5 must undergo a cyclic variation of speed on occasion of roll change.

Once again from FIG. 1D it may be noted that the oscillating arms 37 have brought the roller 39 to press against the winding roller 1, pressing on the length of sheetlike material F and on the weblike material N run over the roller 1. Since the roller 39 was already rotating at a peripheral velocity substantially equal to the rate of feed of the weblike material N and to the peripheral velocity of the roller 1, the pressure of the roller 39 against the roller 1 does not substantially bring about any effect of braking on the weblike material N, but the speed of rotation of the roller 39 and of advance of the weblike material N brings about a sharp acceleration of the length F of sheetlike material, which consequently advances in the direction indicated by the arrow fF towards the nip between the rollers 1 and 3, also by virtue of the fact that the pressure of the roller 39 against the roller 1 brings about a friction sufficient to overcome retention of the sheetlike material by the suction of the suction chamber. The glue C previously applied on the sheetlike material F brings about mutual adhesion between the length F and the weblike material N and hence drawing of the leading edge FT of the length of sheetlike material along the path of advance of the weblike material N.

The speed with which the length of sheetlike material F advances is equal to the peripheral velocity of the winding roller 1, and hence the leading edge FT of the length F encounters the radially projecting portion 15A of the rotating element 15, which (as has been said) rotates at a substantially lower speed. The concave curved surface 15B of the portion 15A of the rotating element 15 deflects the leading portion of the length F of sheetlike material, bringing about (as may be noted in FIG. 1D) start of winding of the length F itself. The adhesion caused by the glue C between the length F of sheetlike material and the weblike material N means that the latter tends to follow the sheet F in its winding.

Figure 1E:
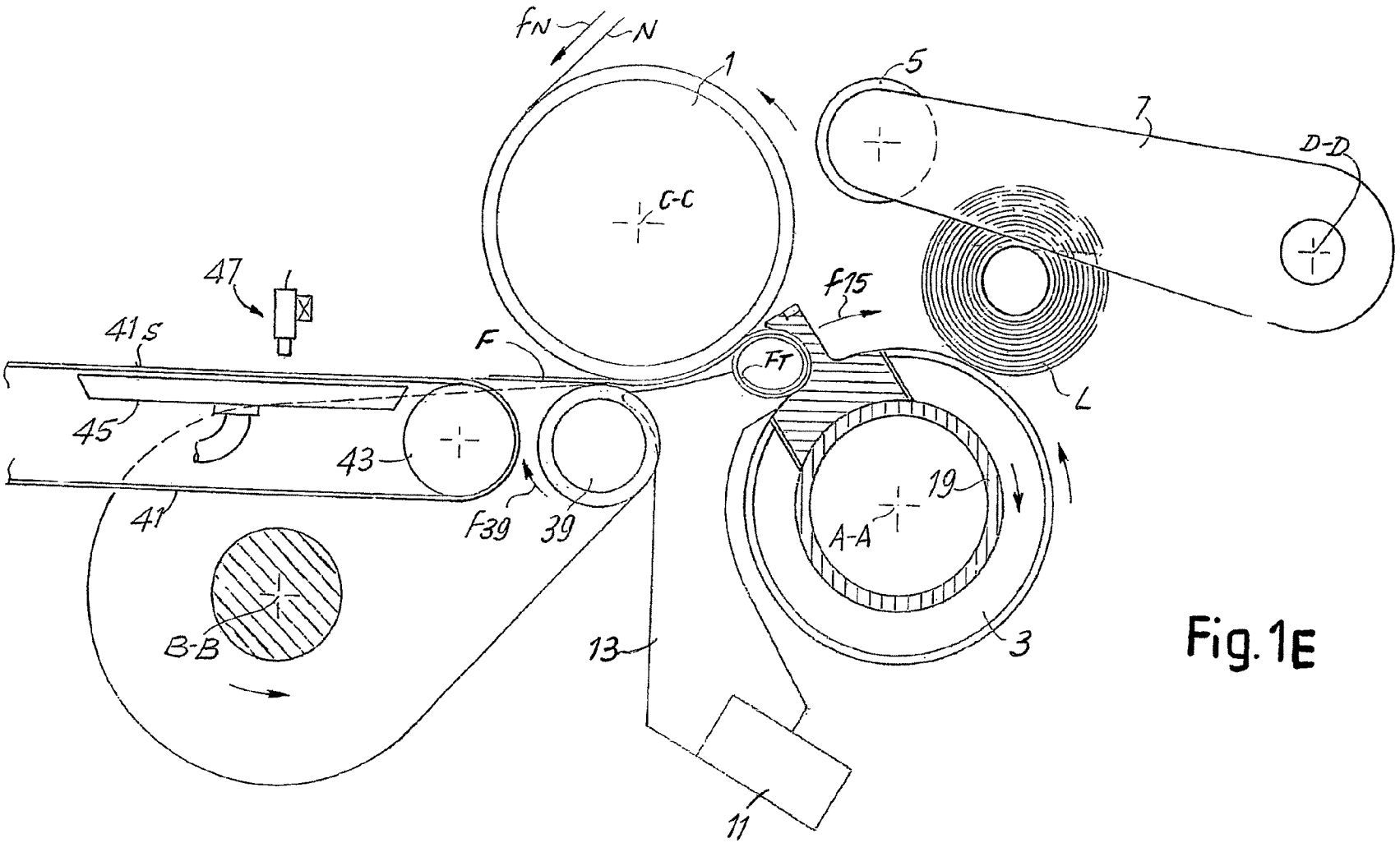

Shown in FIG. 1E is another subsequent instant of the exchange phase. The log L continues its movement of discharge in the direction indicated by the arrow fL whilst the rotating element 15 advances in the direction indicated by the arrow f15 at a substantially lower speed than the speed of advance of the weblike material N. As a result of this, the length or portion of sheetlike material F, which advances, instead, at the rate of feed of the weblike material N (i.e. at the peripheral velocity of the winding roller 1), starts to wind on itself. This winding takes place within a space delimited by the winding rollers 1 and 3, by the radially projecting portion 15A of the rotating element 15, and by the concave surface 13A of the fixed plates 13. The roller 39 is still pressed against the winding roller 1 to favor the thrust forwards of the length or portion of sheetlike material F along the feed path of the weblike material N.

Figure 1F:
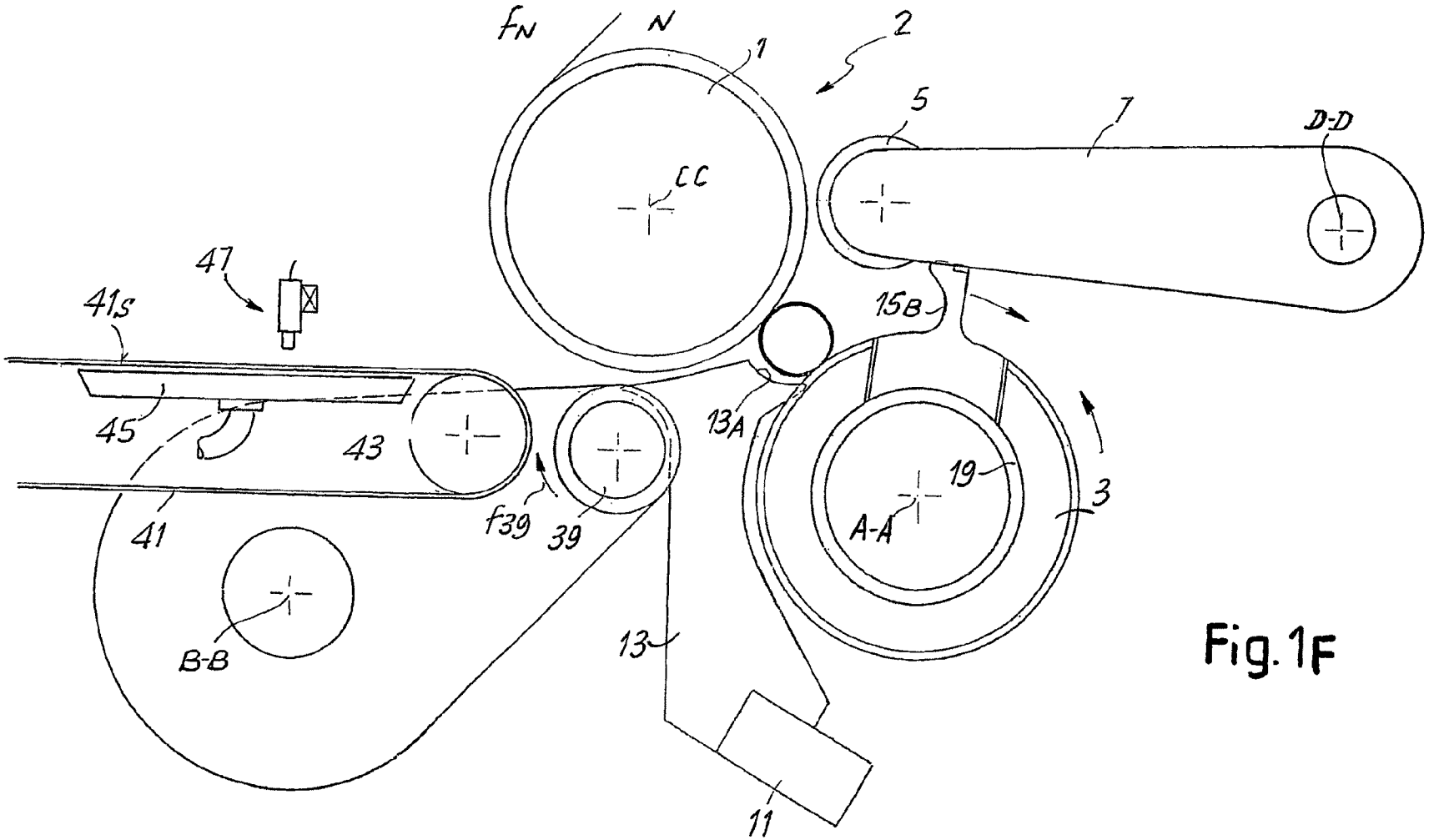
Figure 1G:
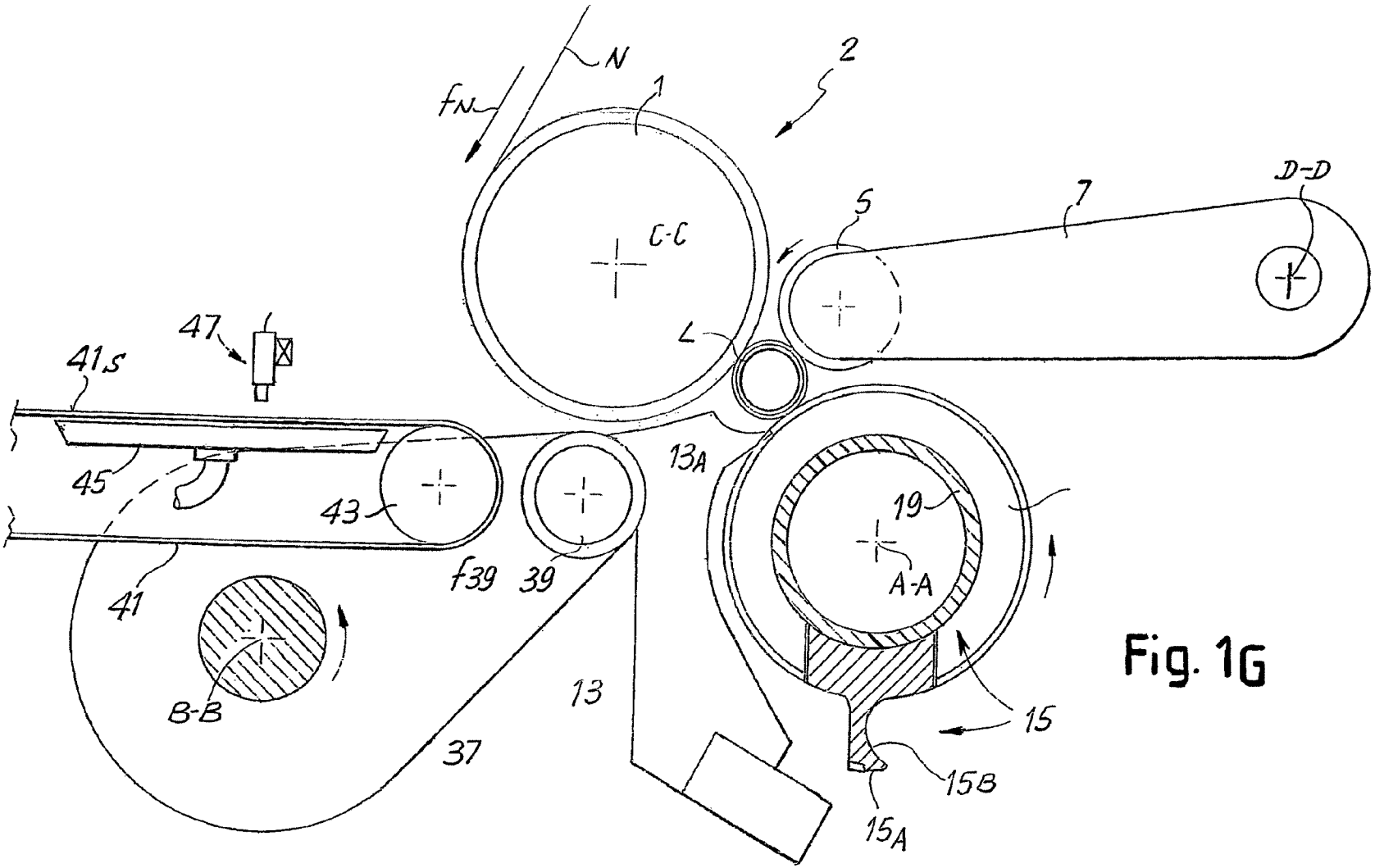

FIG. 1F shows the subsequent step, in which the entire length F of sheetlike material is wound on itself, forming a series of turns (made up of sheetlike material F and weblike material N), and around the latter the turns of just weblike material N start to wind. The rotating element 15 advances in such a way as to lose contact with the roll that is being formed and to position itself in the arrangement of FIG. 1A, where it will remain up to the subsequent exchange phase. The roller 39 has been moved away from the winding roller 1, and the winding roller 5 starts to drop from the position previously reached (FIG. 1E) to enable discharge of the finished log L, until it returns in contact with the new roll that is being formed (FIG. 1G).

Figure 2:
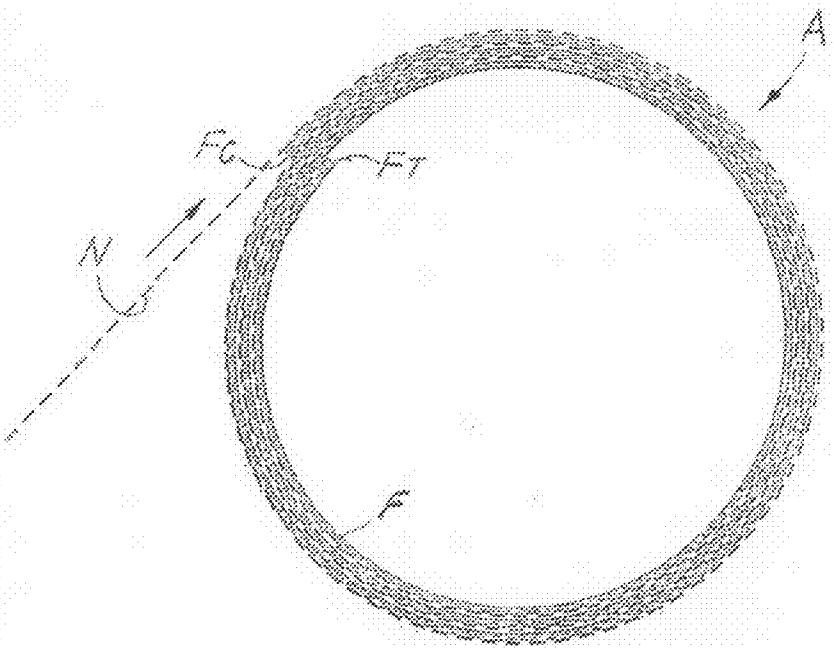

FIG. 2 shows a marked enlargement of the tubular core A obtained by winding the length or portion F of sheetlike material and weblike material N according to what was described previously. Since the sheetlike material has been made to adhere to the weblike material N in the proximity of its own leading edge FT, the turns of the length of sheetlike material F that form the core A are wrapped by the weblike material N, which adheres to the sheetlike material F strictly adjacent to the leading edge FT.

On the other hand, this is not the only procedure of operation. In fact, the members of the rewinding machine can be controlled so as to tear the weblike material N and adhere thereto the length or portion F of the sheetlike material after having substantially completed the winding of the length F to form the tubular core A. This can be obtained (with reference to FIG. 1D) by anticipating the pinching of the length F against the weblike material N by the roller 39 and controlling the rotation speed of the member 15 accordingly. By adapting the face 13A or adjusting it slightly further downwards than what is illustrated, it is possible to obtain a cavity having an approximately round shape for winding at least the first turn of the tube being formed, after which the member 15 continues to rotate and tears the weblike material at a point corresponding to the end-of-winding of the amount of sheetlike material F. In this way, it is possible to obtain adhesion of the weblike material N to the length F of sheetlike material, as shown in FIG. 3.

Figure 3:
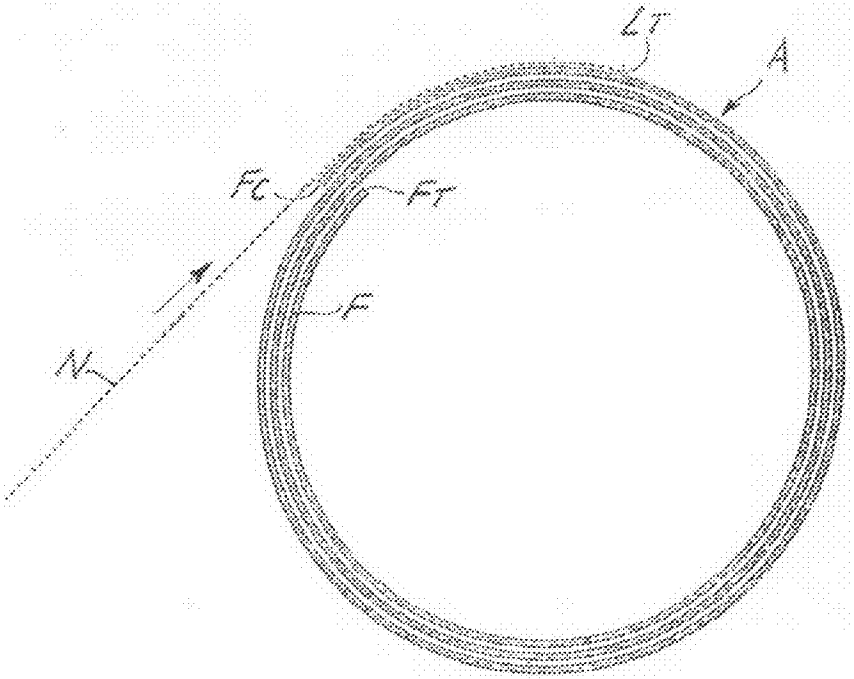
FIGS. 2 and 3 show markedly enlarged cross sections of the winding core formed by the rewinding machine of FIGS. 1A to 1G.

The result of this operating procedure is represented by the enlargement of FIG. 3. Here it may be noted that the initial leading edge LT of the weblike material N is made to adhere in the proximity of the terminal area (close to the trailing edge FC) of the length of sheetlike material F.

Figure 5:
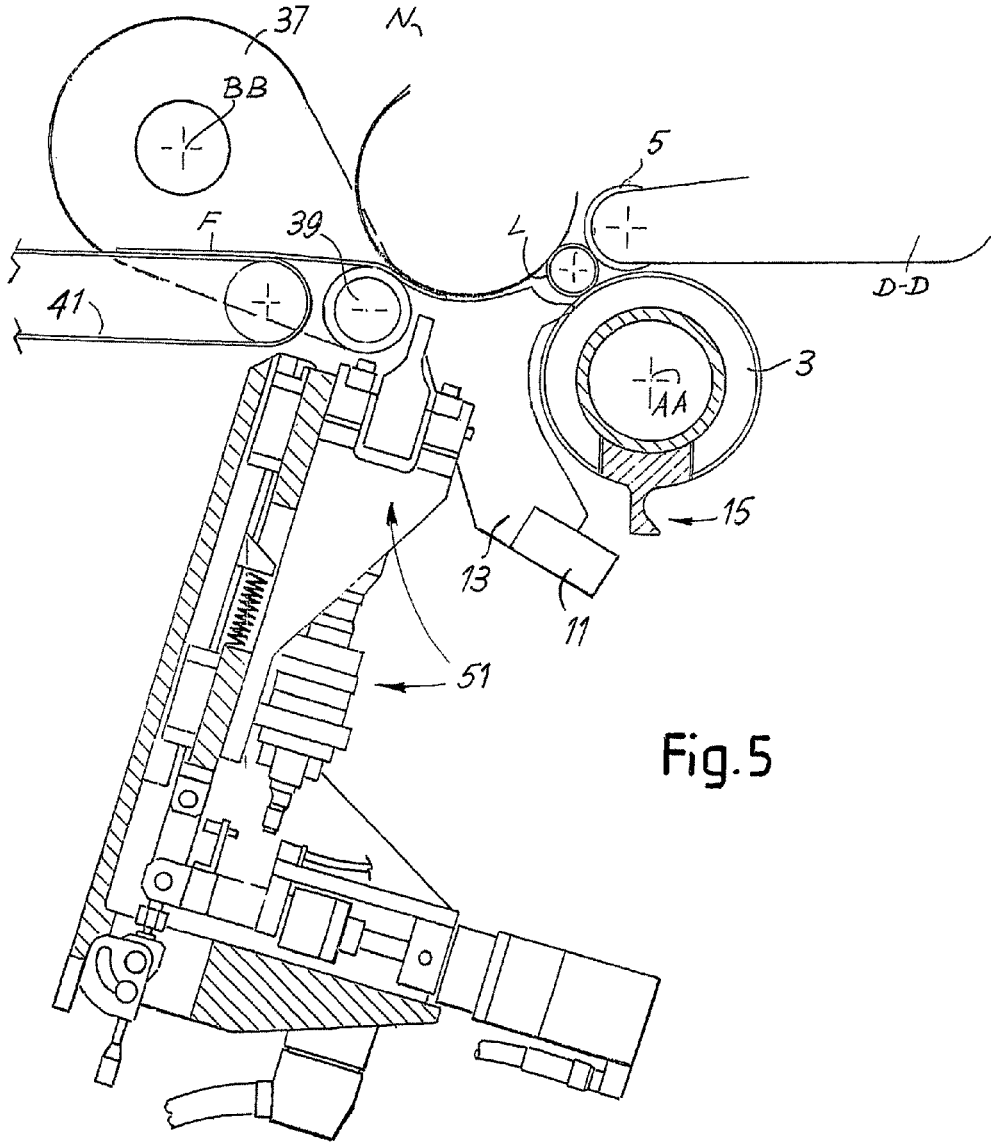
FIG. 5 shows a diagram of a modified embodiment of the rewinding machine of FIGS. 1A to 1G.

As described previously, reference is made to a system of gluing for causing the length of sheetlike material F to adhere to the weblike material N. However, this is not the only way to bring about mutual adhesion of the two products. It is possible, instead, to use, for example, an ultrasound system, as schematically represented in FIG. 5. In this Figure, the same numbers designate parts that are the same or equivalent to those of FIGS. 1A to 1G. The roller 39 is still carried by oscillating arms 37, which are, however, hinged about an axis B-B that it is arranged above rather than underneath the conveyor belt 41. This makes more space available in the underlying area, where a plurality of sonotrodes 51 are arranged, aligned according to the axis C-C of the winding roller 1 and located between consecutive plates 13. The sonotrodes 51 are activated at the moment in which the length or portion of sheetlike material F must be made to adhere to the weblike material N, instead of using glue C. The remaining operation of the rewinding machine schematically represented in FIG. 5 is the same as the one described above.

FIGS. 6A to 6D show the operating sequence and the structure of a different embodiment of a rewinding machine according to the invention. In this embodiment, the rewinding machine again comprises a first winding roller 1, a second winding roller 3, and a third winding roller 5, the latter being carried by oscillating arms 7 hinged about an axis of oscillation D-D. Provided between the rollers 1 and 3 is a nip 4, through which the weblike material N passes. Designated by L is a log or roll that is being formed around a core A formed by winding turns of a length or portion of sheetlike material F according to what is described herein below.

Arranged upstream of the nip 4 defined between the winding rollers 1 and 3, is a set of plates 101 forming a concave surface 103 approximately concentric with respect to the cylindrical surface of the winding roller 1 and defining a channel 105 of advance of a forming spindle, around which a length F of sheetlike material winds in turns. Set underneath the channel 105 is a rotating member 107. The configuration so far described is substantially equivalent to the one illustrated in detail in U.S. Pat. No. 5,979,818 or in U.S. Pat. No. 6,648,266, to which the reader is referred for a detailed description.

Inserted in the channel 105 are forming spindles M, instead of tubular cores. The forming spindles M are picked up from a feeder 108 by means of a gripper 109 carried by a rotating assembly 111 with an axis of rotation E-E. The spindles M are perforated, and within them a suction can be generated by means of a mobile suction mouth, with a configuration substantially similar to the one described in U.S. Pat. No. 6,595,458. In this way, when the forming spindle M is inserted in the channel 105, suction is generated therein, which causes adhesion of the sheet F that forms, around said spindle, the turns defining the winding core A on which the roll or log L of weblike material N will subsequently will be wound.

Adjacent to the winding roller 1, arranged upstream of the inlet of the channel 105, is a roller 39 supported by a pair of arms 37 oscillating about the axis B-B. The roller 39, the arms 37, and the axis of oscillation B-B are equivalent to the members bearing the same reference numbers in the example of FIGS. 1A to 1G, except for the different arrangement of the axis of oscillation and of the supporting arms.

The rewinding machine further includes a conveyor belt, again designated by 41, entrained around two guide rollers, one of which is designated by 43 in the figure. The conveyor belt 41 is associated to a suction chamber 45 and to a series of glue nozzles 47.

Figure 6A:
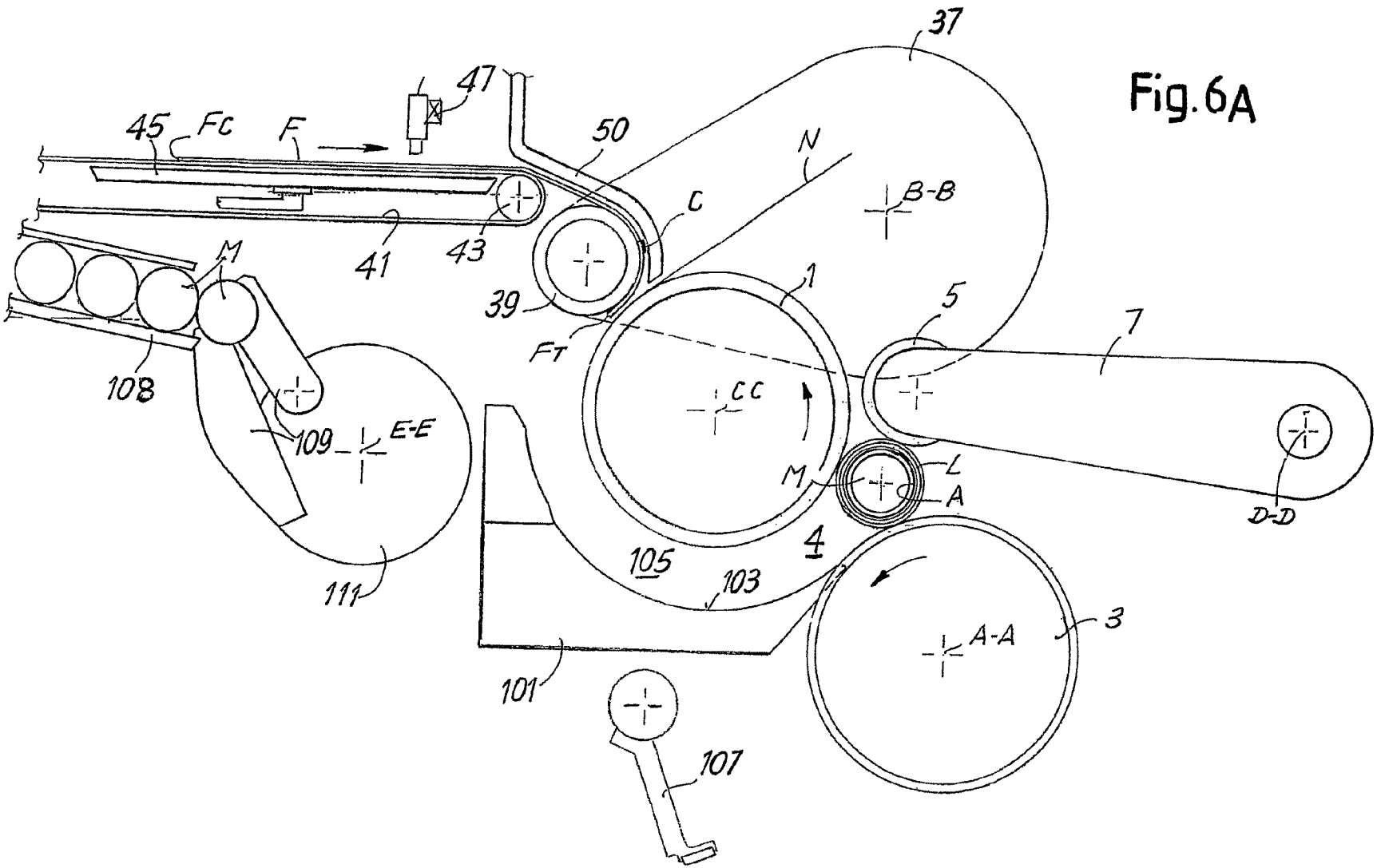
FIGS. 6A to 6D show subsequent operating steps of a rewinding machine according to the invention in a different embodiment.

Set between the guide roller 43 of the conveyor belt 41 and the rotating roller 39 is a deflector 50, which guides the leading part FT of the sheetlike material F around the roller 39, until it takes the position illustrated in FIG. 6A. The roller 39 can be a suction roller for keeping the front edge or leading part FT of the length or portion F of sheetlike material adherent thereto, the suction within the roller 39 being in any case less than the suction exerted by the suction chamber 45 so that in the arrangement of FIG. 6A the length of sheetlike material remains in a static position.

Operation of the rewinding machine in this configuration is illustrated in the sequence of FIGS. 6A to 6D.

In FIG. 6A the length F of the sheetlike material is withheld by the suction exerted by the suction chamber 45, and its leading edge FT is located in the space between the roller 39 and the winding roller 1, with the glue C applied thereon. To prevent the glue C from coming into contact with the deflector 50, it can be applied in patches or stretches corresponding to free spaces between mutually parallel slats or sectional elements, which form as a whole the deflector 50.

In the cradle formed by the winding rollers 1, 3, 5, the roll or log L is being formed around a core A, which in turn is being formed on a forming spindle M, which was previously inserted in the machine.

Figure 6B:
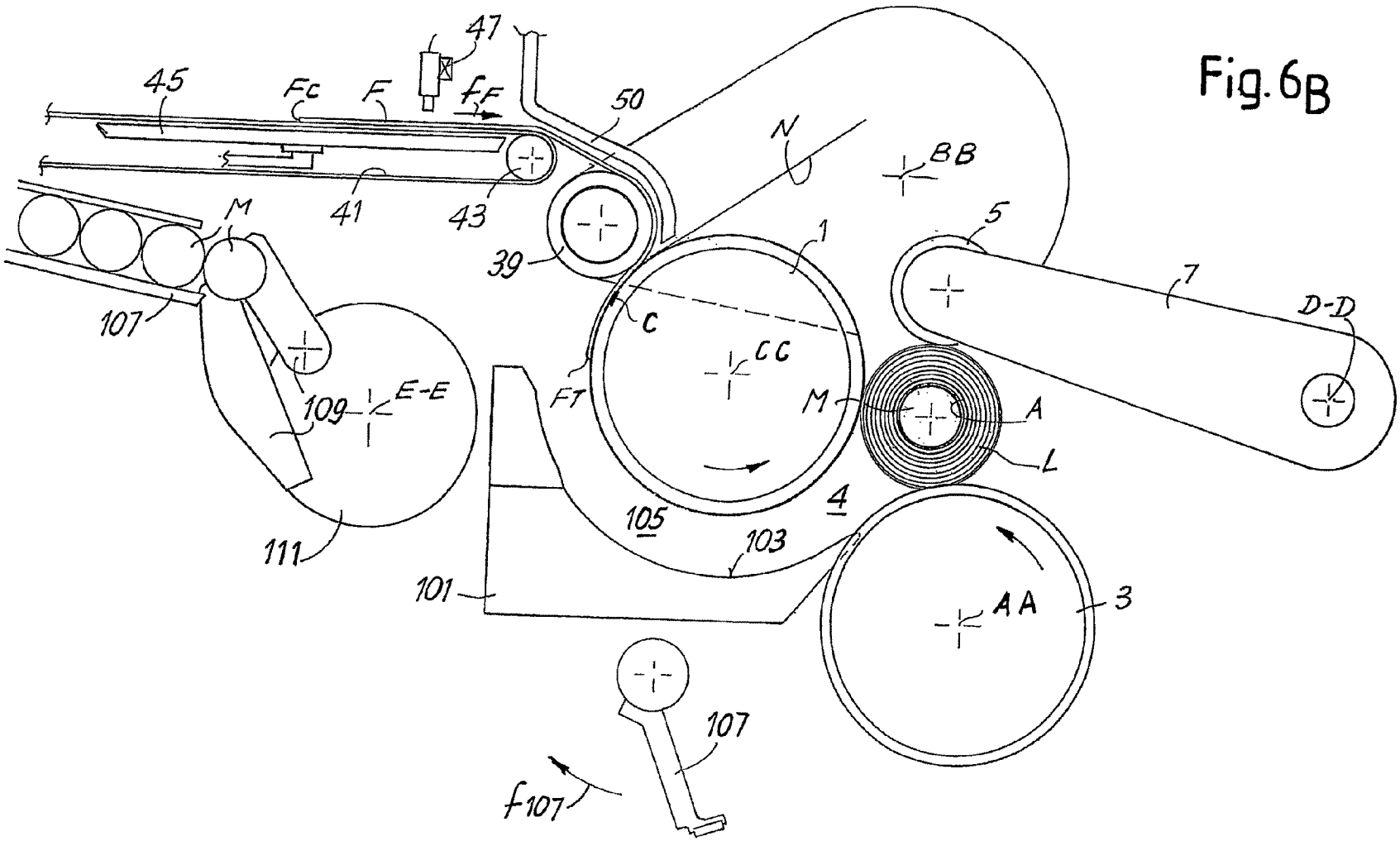

In FIG. 6B the log L is practically complete. The roller 39, which rotates at a peripheral velocity equal to the peripheral velocity of the winding roller 1 and hence at the rate of feed of the weblike material N, is brought up against the roller 1, so as to pinch the weblike material N and the length or portion F of sheetlike material against one another and between the rollers 39 and 1. This causes start of drawing of the length F in the direction indicated by the arrow fF and mutual adhesion between said length F and the weblike material N as a result of the glue C previously applied by the nozzles 47. The rotating member 107 starts to rotate in the direction indicated by the arrow f107.

Figure 6C:
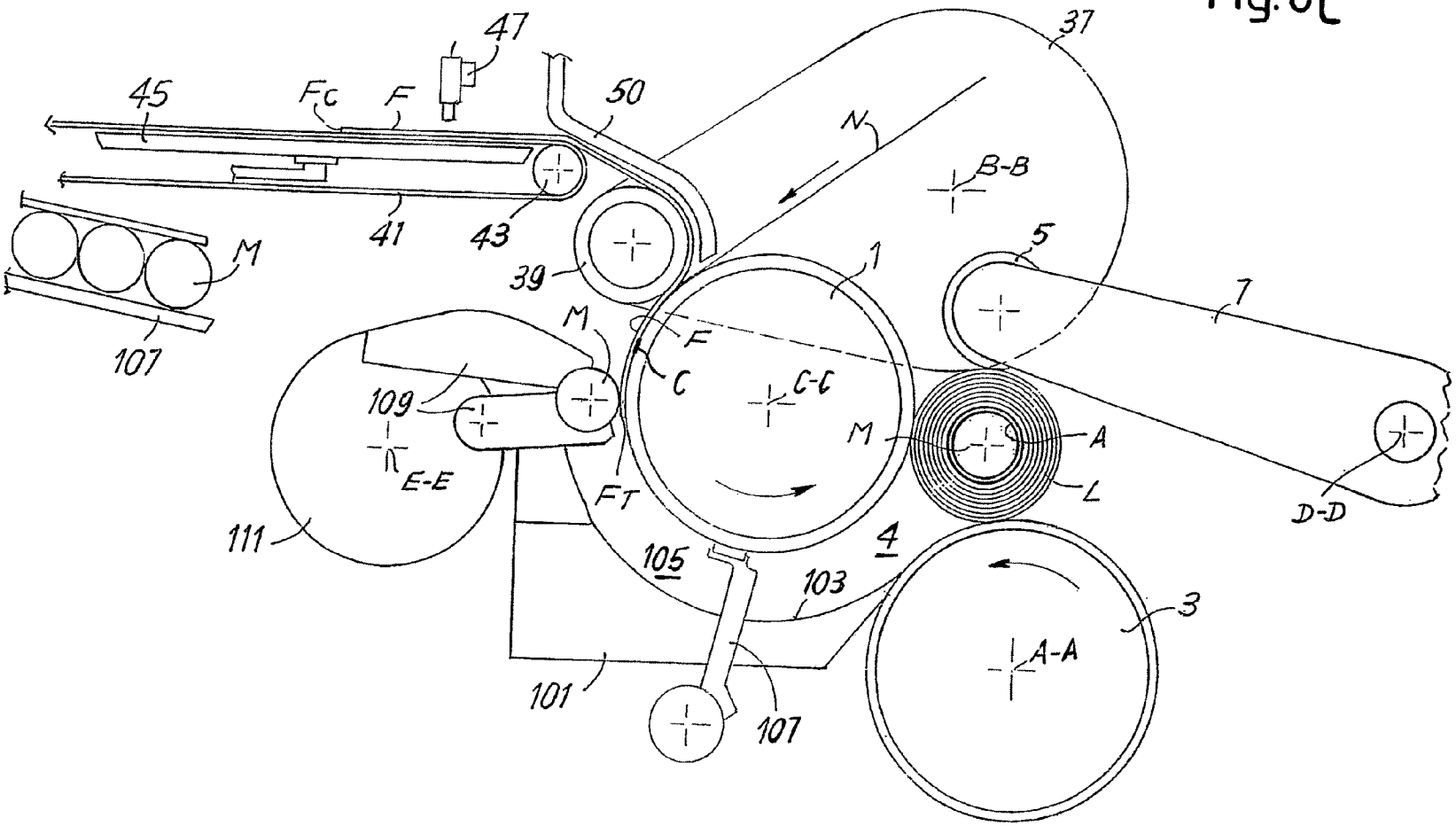

In FIG. 6C, the rotating member 107, the peripheral velocity of which is substantially lower than the rate of feed of the weblike material N and the peripheral velocity of the winding roller 1, is pinching the weblike material N against the winding roller 1. A new forming spindle M has been brought by the gripper 109 to the inlet of the channel 105. The insertion of the spindle M is synchronized with the position of the leading edge FT of the length of sheetlike material F, so that the latter is pinched between the spindle M and the winding roller and in contact with the weblike material N run over the latter. Within the forming spindle M, which has a perforated cylindrical skirt, there is generated a pressure lower than atmospheric pressure via a suction mouth (configured as described in U.S. Pat. No. 6,595,458), which follows the movement of advance of the spindle M along the channel 105. This advance is obtained, once the gripper 109 opens and releases the spindle M, owing to the fact that the spindle M is forced between the fixed concave surface 103 and the rotating cylindrical surface of the winding roller 1. The axis of the spindle M then advances along the channel 105 at a speed equal to one half of the peripheral velocity of the roller 1.

Figure 6D:
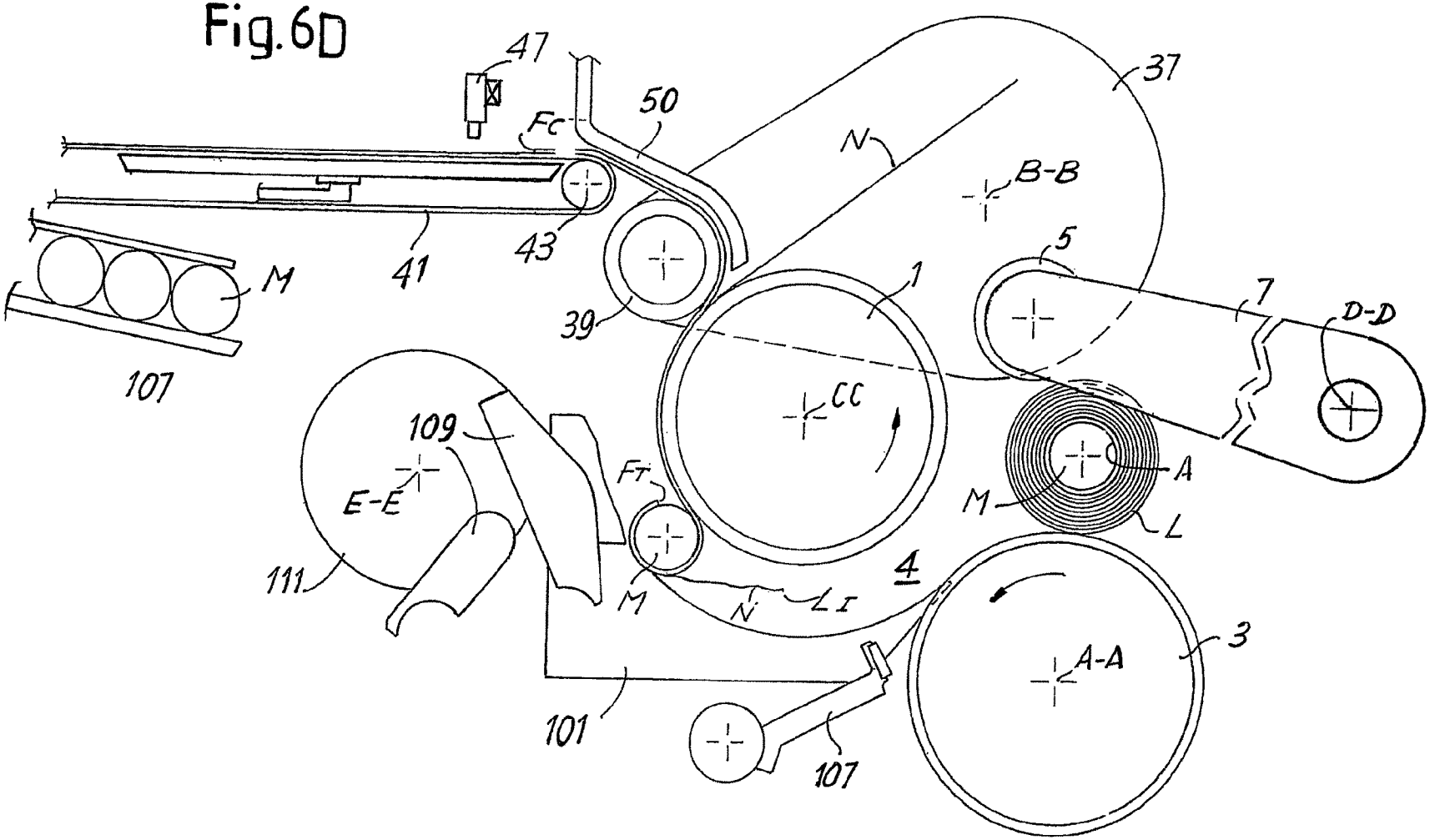

FIG. 6D illustrates the subsequent step, in which the complete log or roll L is unloaded from the winding cradle as a result of the variation of the peripheral velocity of the roller 3 and/or of the roller 5, whilst the weblike material N has been torn by the rotating member 107 for generating the free leading edge LI.

The weblike material N is adherent to the surface of the length F of the sheetlike material as a result of the glue C, and this length in turn adheres to the cylindrical surface of the forming spindle M as a result of the suction exerted through its skirt. It follows that the sheetlike material F winds, forming a series of turns around the forming spindle M, and together with these turns also the first turns of weblike material N that will form the subsequent log or roll are wound around the forming spindle M. The advance of the forming spindle M by rolling along the channel 105 continues until it reaches the nip 4 and from there it will pass into the winding area formed by the rollers 1, 3 and 5, and around the forming spindle M, as well as around the turns formed by the length F of the sheetlike material, the roll or log L will be formed.

Once the log L is unloaded from the rewinding machine, the forming spindle M can be taken out in a way known per se and recycled for carrying out a new winding cycle of a subsequent log around it.

In this embodiment, as well as in the previous one, the mutual adhesion between the length F of the sheetlike material and the weblike material N can be obtained also in the absence of glue and without resorting to the sonotrodes 51 (FIG. 5), for example with a system of mechanical ply-bonding by suitably configuring the roller 39, which can assume, for example, the form of a set of ply-bonding wheels pressed with adequate pressure against the outer cylindrical surface of the winding roller 1.

Shown in FIGS. 7A-7E is a further embodiment of a rewinding machine according to the invention. In this case, again designated by 1, 3 and 5 are the winding rollers, the third roller being supported by a pair of oscillating arms 7 hinged about the axis D-D. Designated by N is the weblike material, which advances in the direction indicated by the arrow fN along the feed path.

Run over the winding roller 1 is a belt or a set of belts or other flexible member, designated by 201, which is additionally run over a guide roller 203. Run over the winding roller 3 is a second similar flexible member 205, which is additionally run over a guide roller 207. The two flexible members 201 and 205 have two branches 201R and 205R approximately parallel to one another, which define a channel 209 for introducing the winding cores that are being formed, as in the previous cases and as described hereinafter in greater detail, by winding a length F of sheetlike material on itself.

Also in the example of FIGS. 7A-7E a rotating roller 39 is provided, which can be supported by a pair of oscillating arms in order to be cyclically brought up to the roller 203, or else can be kept permanently pressed against the roller 203 since it rotates at a peripheral velocity equal to that of the weblike material N and of the roller 202. In the example described herein, reference will be made to this second configuration. The guide roller 203 has (like the roller 207) grooves, in which the belts forming the flexible member 201 (or else the flexible member 205 for the roller 207) are housed.

The sheetlike material is fed in the form of a continuous sheet, for example by means of a pair of rollers 230 associated to a guide surface 232. The leading part FT of the sheet is brought onto the surface of the rotating roller 39 and stopped in front of the nip between the roller 39 and the roller 203. In the example illustrated, the roller 39 has a suction sector 39A, terminating approximately in an area corresponding to the nip between the rollers 39 and 203. The cylindrical surface of the roller 39 can be integrally perforated, or perforated in annular bands in order to withhold the front portion of the sheet F adherent to the cylindrical surface of the roller 39 up to the moment in which the sheet has to be inserted into the machine, according to the procedure described hereinafter.

In this embodiment, the sheet F is perforated transversely. Designated by PF is a perforation line along which the sheet F is torn to form a first length of sheetlike material that will generate the subsequent tubular winding core. Set above the plane 232 is a series of nozzles 47, which apply a line of glue C in the proximity of the front edge FT of the sheet F when this passes as it advances towards the nip between the rollers 39 and 203.

Associated to the channel 209, defined by the two branches 201R and 205R of the flexible members 201 and 205, there is provided a first fixed member 211 forming a concave surface 211A, which forms, together with a second concave surface 213A formed on a rotating element 213, a space for winding the tubular cores. The element 213 is provided with an oscillating motion as indicated by the double-headed arrow f213 about the axis F-F of rotation of the guide roller 207.

Figure 7A:
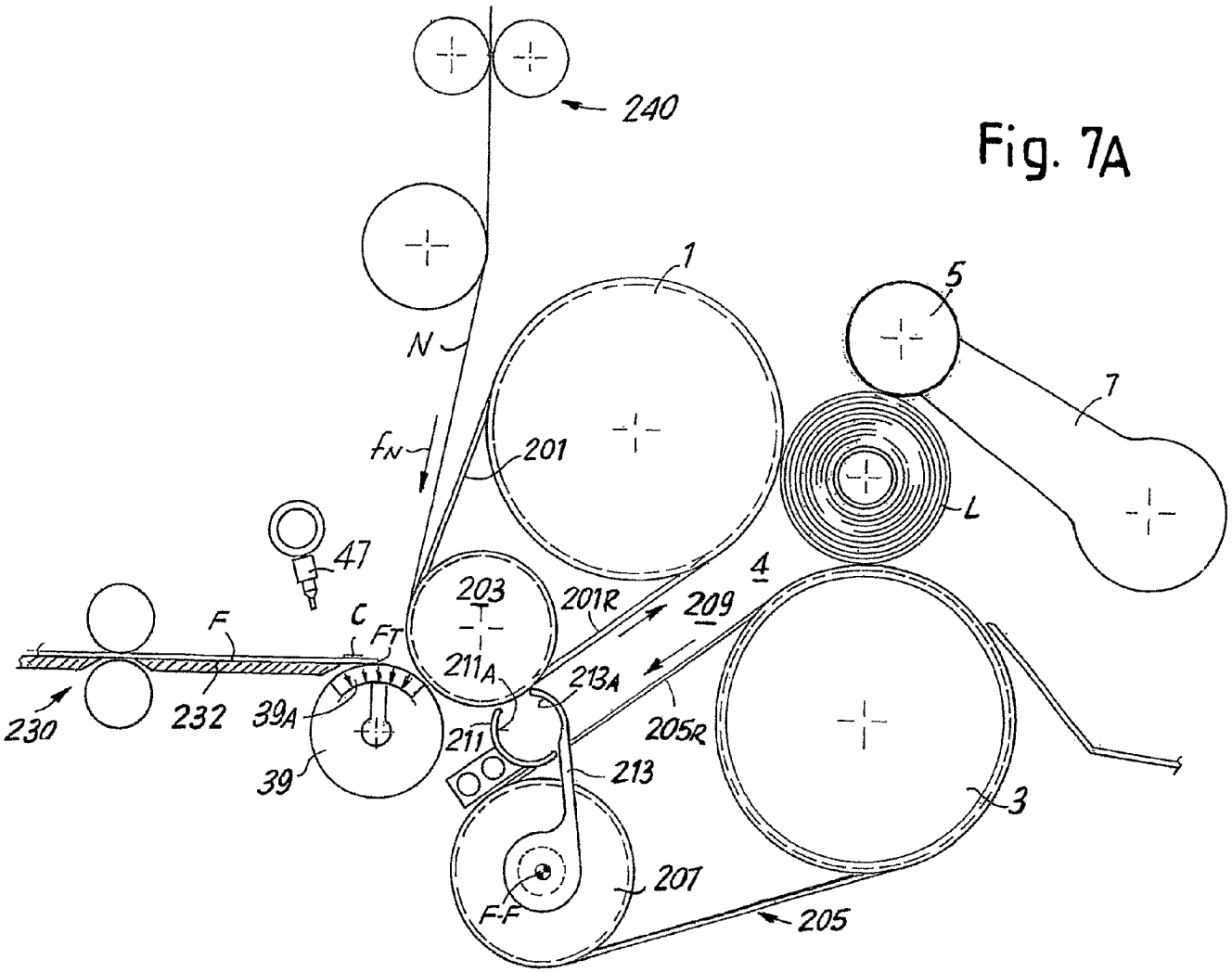
FIGS. 7A-7E show a further embodiment of a rewinding machine according to the invention and the sequence of operation in the step of production of a new winding core.

In the arrangement of FIG. 7A, the winding space formed by the surfaces 211A and 213A is closed, i.e., these two surfaces are not in the position in which the winding of the length of sheetlike material F starts in order to form the subsequent tubular winding core.

The process of formation of the winding core is described in what follows (see the sequence FIGS. 7A-7E). At the instant in which it is formation of the tubular core starts, the rollers 230 advance of the leading edge FT of the sheet F within the nip between the roller 39 and the roller 203, which are kept in rotation at the peripheral velocity equal to the rate of feed of the weblike material N. This causes pinching of the sheetlike material F and hence acceleration of said material, which is torn along the subsequent line of perforation PF that passes beyond the rollers 230. To facilitate tearing, the line of perforation can be slightly inclined with respect to the axis of the rollers 39, 203, 203A in such a way that tearing may occur progressively and not instantaneously.

Figure 7B:
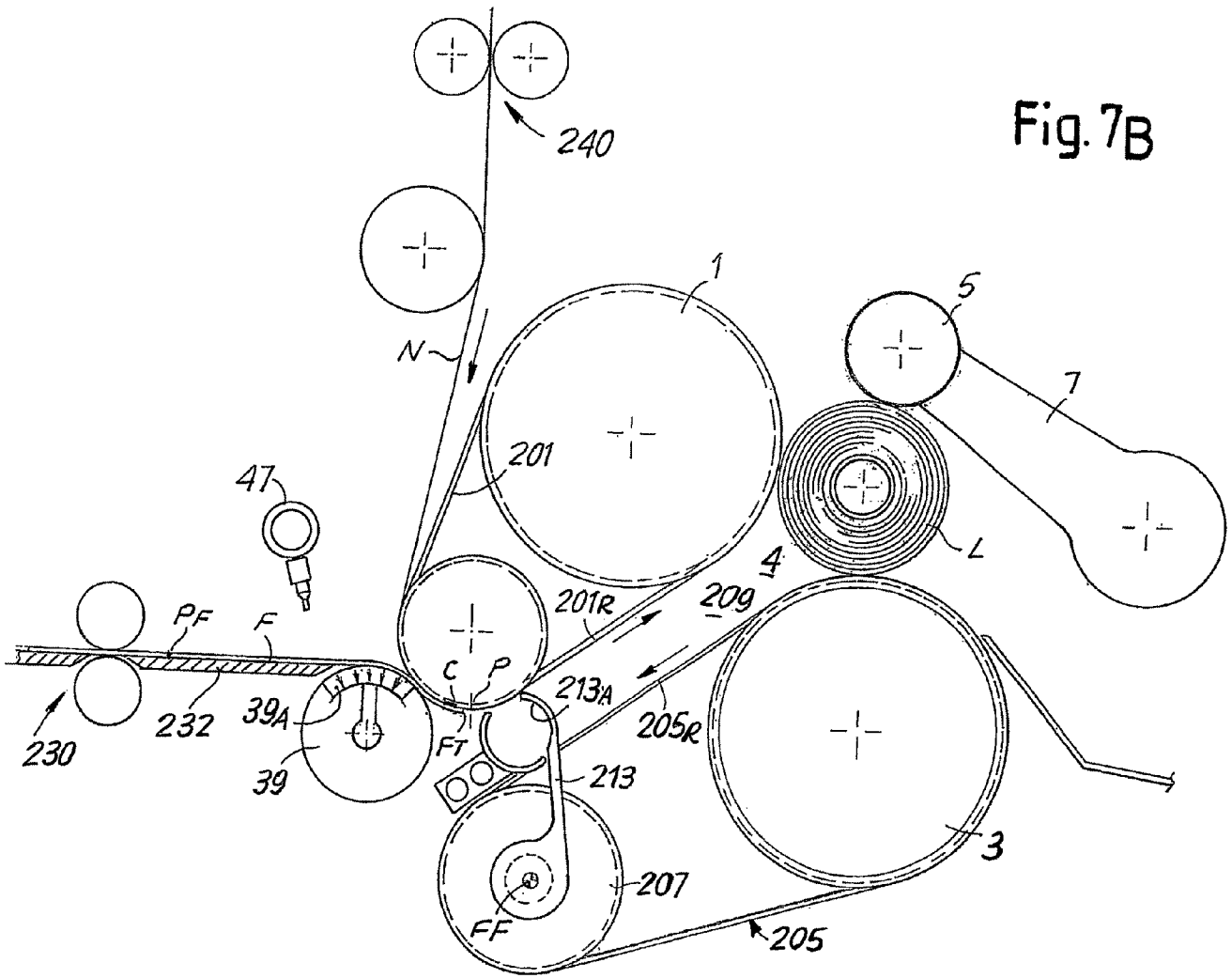

The line of glue C, which has been applied by the nozzles 47 behind the leading edge FT, brings about adhesion between the sheet F and the weblike material N. The sheetlike material F thus advances together with the weblike material N along the feed path of the material N itself towards the channel 209, as shown in FIG. 7B. The introduction of the length of sheetlike material F is synchronized with the position of the lines of perforation P generated on the weblike material N by a perforator assembly, designated as a whole by 240 and known per se. The synchronization is such that the leading part FT of the sheet F is made to adhere to the weblike material N in the vicinity of a line of perforation P, and more exactly in a slightly retracted position (with respect to the direction of feed), behind the perforation.

Figure 7C:
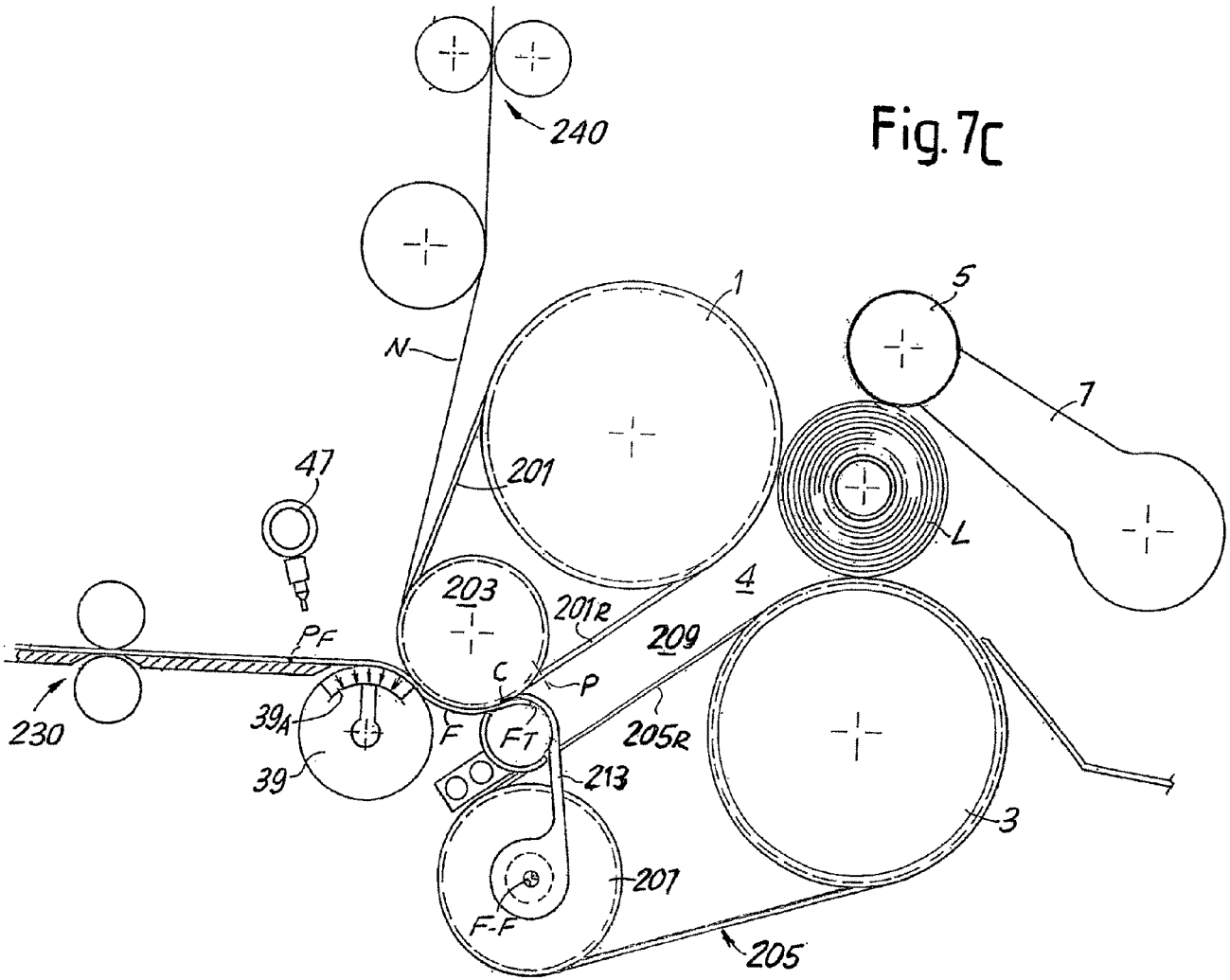
Figure 7D:
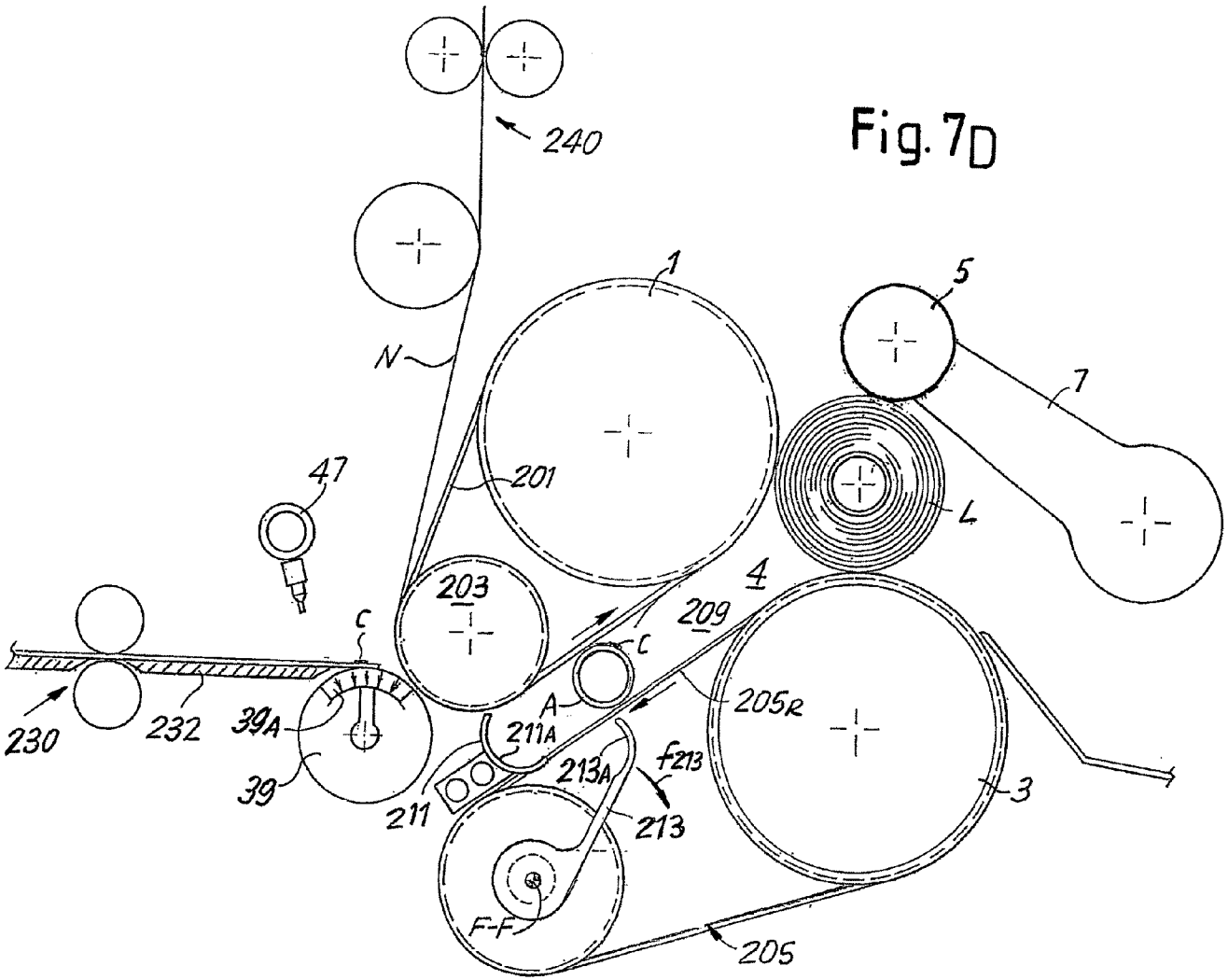

Advancing together with the weblike material N, the leading edge FT of the sheetlike material comes into contact with the surface 213A of the element 213 and is by this deflected downwards and within the space defined by the elements 211, 213, to start winding of the first turn of the tubular core (FIG. 7C). The adhesion previously obtained of the sheetlike material F on the weblike material N by pressure between the roller 39 and the roller 203 causes the weblike material N to be pulled by the sheetlike material F within the winding space delimited by the concave surfaces 211A and 213A. This causes tearing of the weblike material N along the line of perforation P, with consequent start of winding on itself in the space formed by the surfaces 211A and 213A not only of the sheetlike material F, but also of the initial part of the weblike material N that will form the new roll L.

Figure 7E:
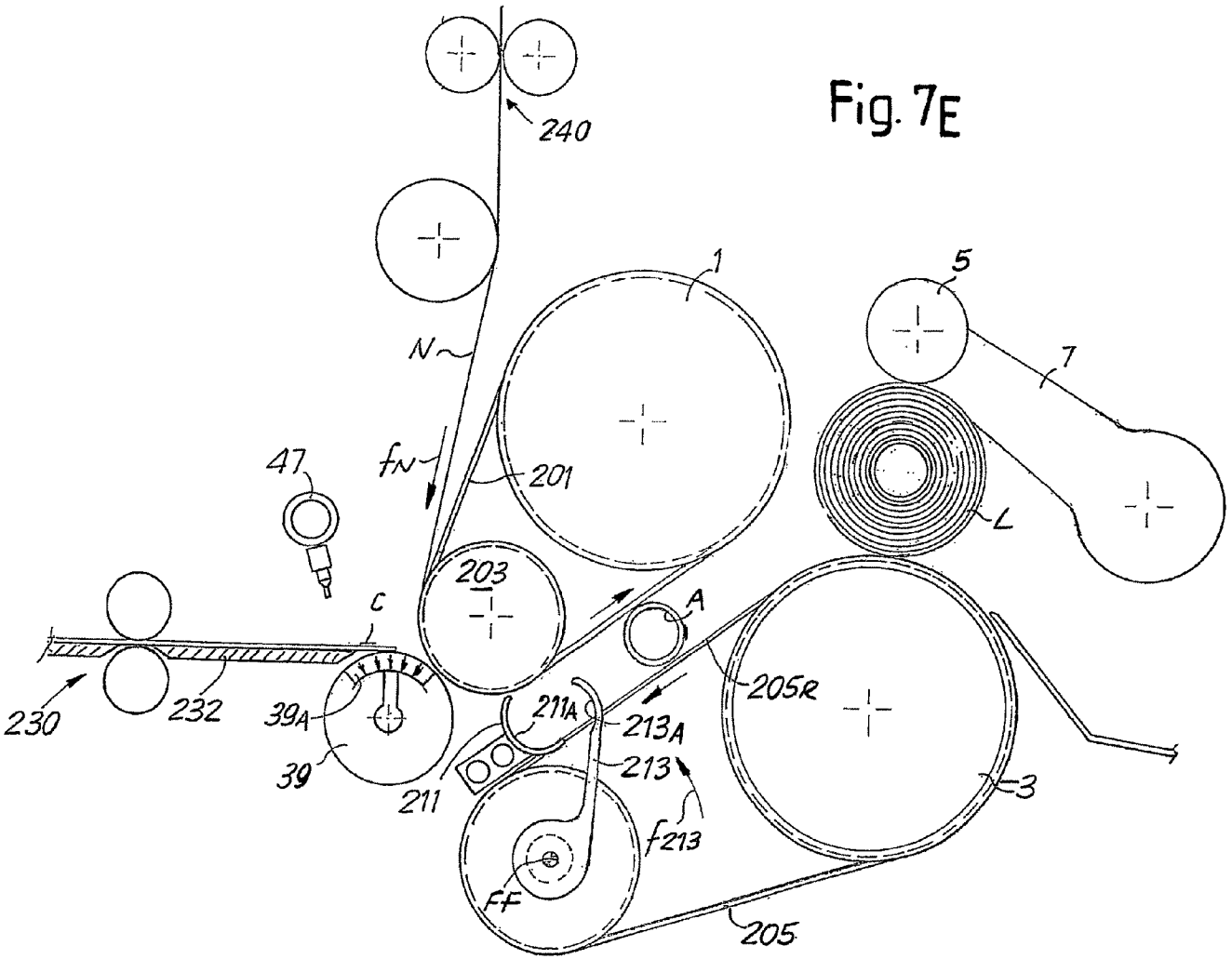

Once winding of the length of sheetlike material F is completed, the mobile element 213 oscillates in a clockwise direction (FIG. 7D), so enabling the tubular core A thus formed and the turns of weblike material N that have started to wind together with the sheetlike material F to advance along the channel 209 as a result of the contact with the mutually parallel and rectilinear branches 201R, 205R of the flexible members 201 and 205. When the core A advances sufficiently, the mobile element 213 is brought back towards the initial position (FIG. 7E). The core A, with the initial turns of weblike material N wound around it, continues to roll as far as the nip 4 between the winding rollers 1 and 3, and beyond said nip and positions itself in the winding cradle 1, 3, 5 and gives rise to the formation of the log or roll L in a substantially traditional way.

During the tearing of the weblike material N and formation of the tubular core A, also unloading of the finished roll L takes place as a result of the difference of speed between the roller 5 and the roller 3.

Figure 8:
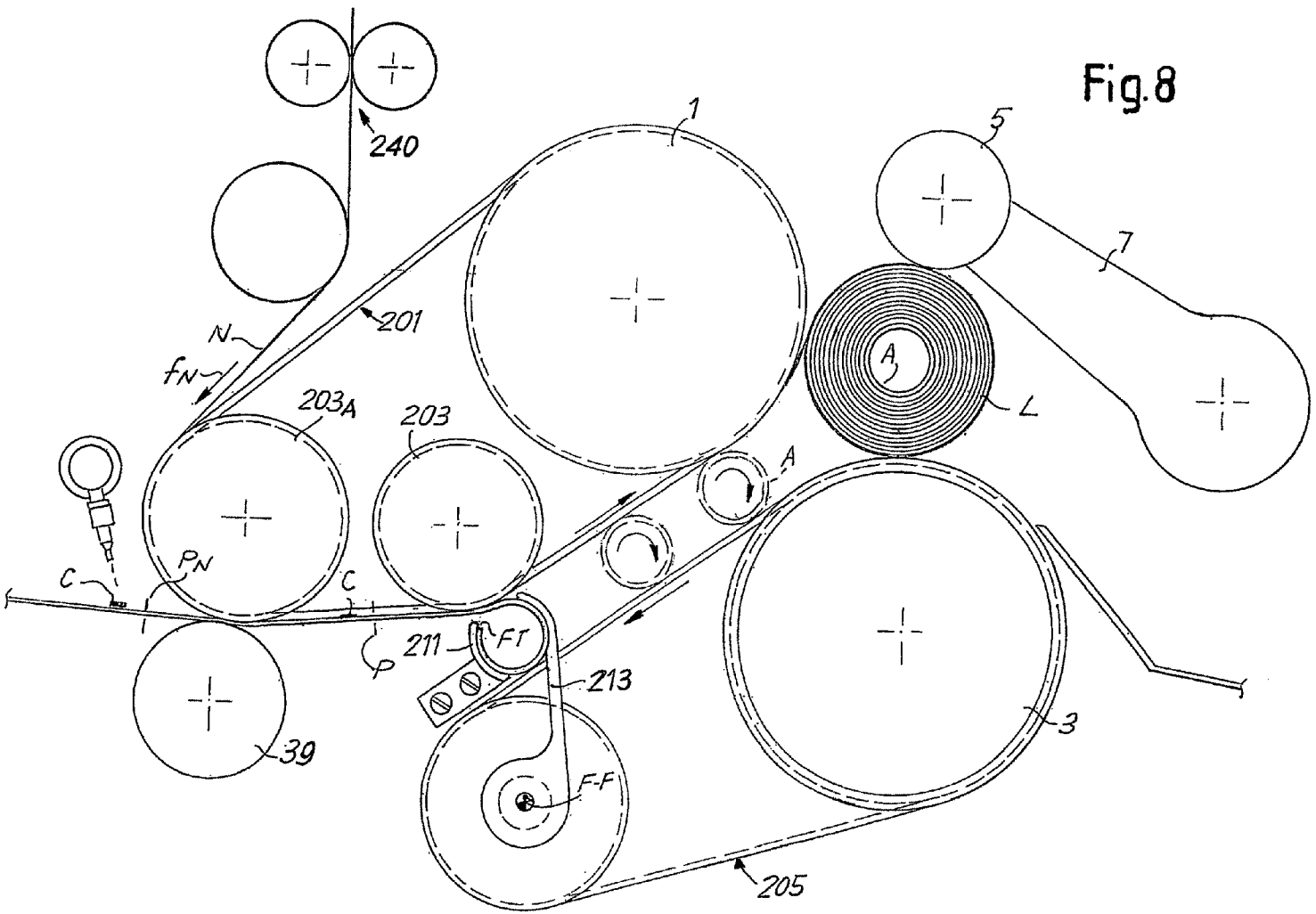
FIG. 8 shows a modified embodiment of FIGS. 7A-7E.

FIG. 8 shows a modified embodiment of the rewinding machine of FIGS. 7A-7E. Parts that are the same as or equivalent to the ones illustrated in FIG. 7 are designated by the same reference numbers. In this embodiment, the flexible member 201 is run, not only around the roller 203 but also around a further guide roller 203A. The roller 39 co-operates with the roller 203A instead of with the roller 203, whilst the latter co-operates with the concave surfaces 211A and 213A as in the example of FIGS. 7A-7E to close the winding space delimited by the latter. The operation of the rewinding machine illustrated in FIG. 8 is otherwise substantially equivalent to the one referred to in FIGS. 7A-7E.

In the configurations of FIGS. 7A-7E and 8, unlike the ones previously illustrated, tearing of the weblike material N occurs by excess of tensile force of the weblike material N exerted on a line of perforation due to the different path imposed upon the sheetlike material F with respect to the path of the weblike material, instead of by braking of the weblike material N by mechanical means or means of another nature.

Figure 9:
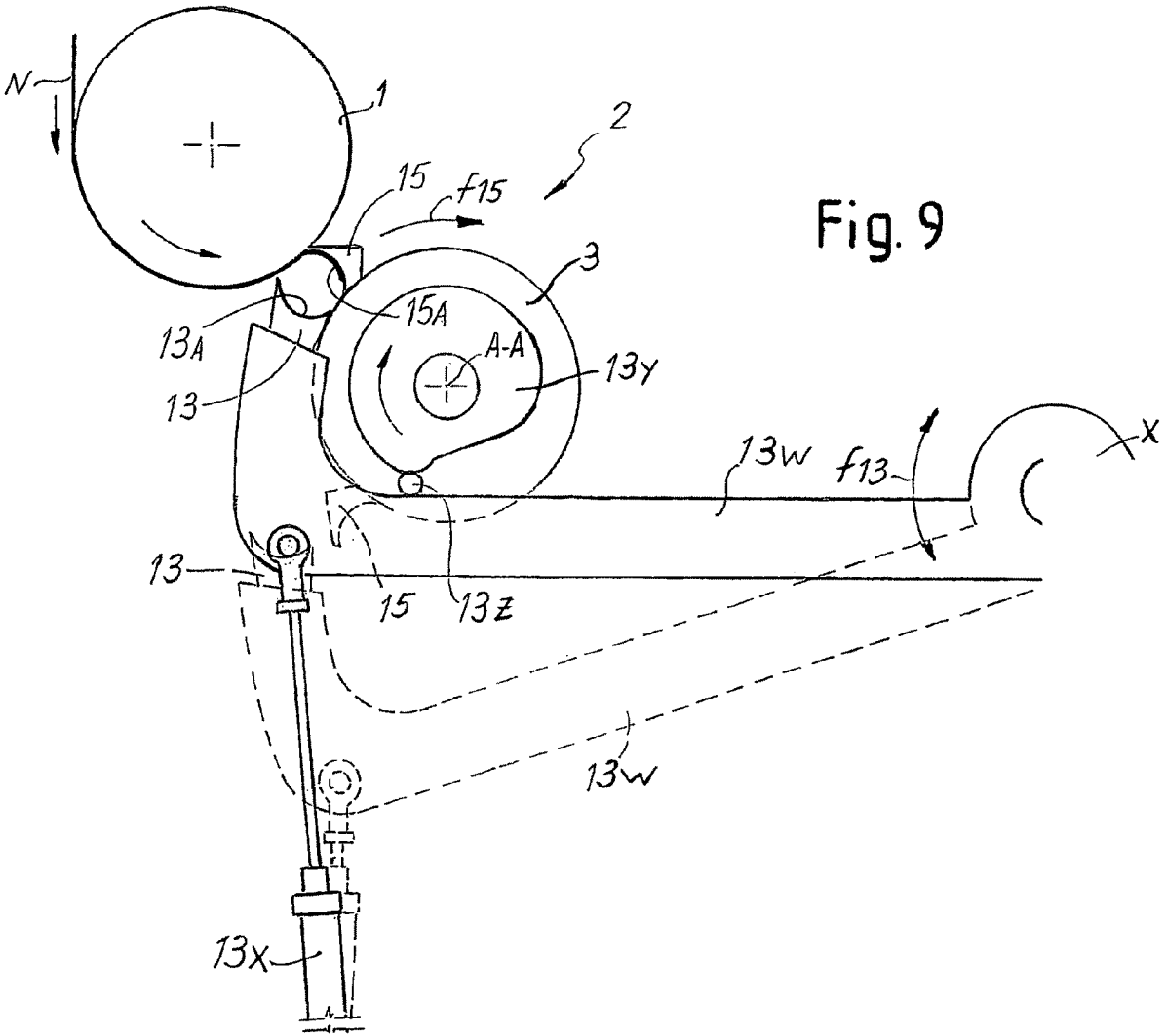
FIG. 9 shows a further embodiment of the invention, in a view similar to that of FIGS. 1A-1G, 4, where the illustration is limited to the members modified with respect to said preceding solution.
Figure 10:
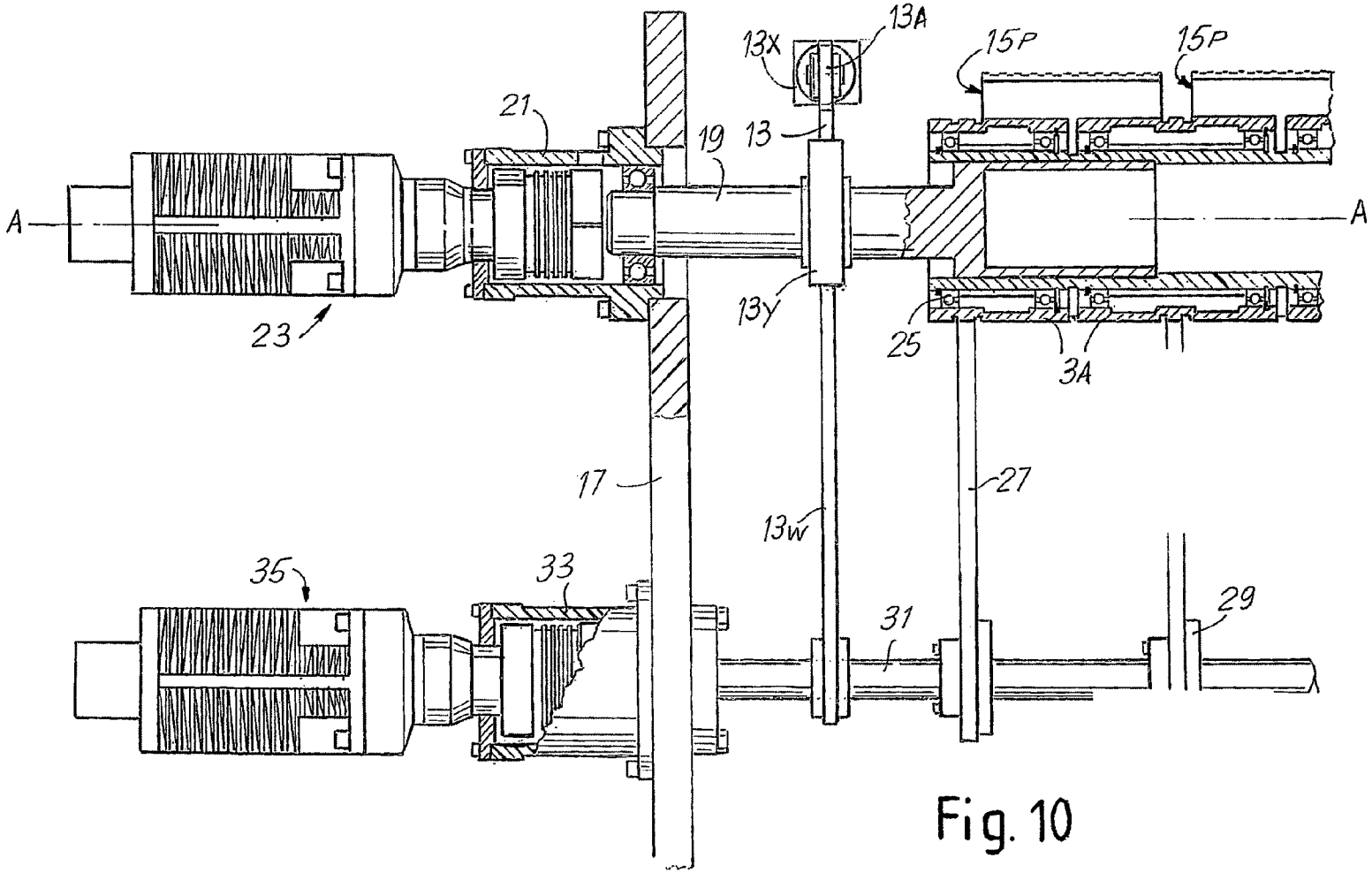
FIG. 10 shows a view similar to that of FIG. 4, of the embodiment of FIG. 9.

Illustrated in FIGS. 9 and 10 is a variant of the embodiment of FIGS. 1A-1G, 4, limitedly to some members that differ from the ones illustrated in the embodiment previously described. Parts that are the same as or equivalent to the ones of the previous embodiments are designated by the same reference numbers. Also in this case a winding unit or winding system 2 is provided, comprising a first winding roller 1 and a second winding roller 3, defining the nip through which the weblike material passes and through which also the winding core advances, whilst it is being formed or after its formation, possibly with a part of turns of weblike material already wound around it. Designated by 13 and 15 are two elements that define (at the start of each winding cycle) the space for the formation of winding cores. Designated by 13A, 15A are concave surfaces of the elements 13, 15, which are to set themselves opposed to one another when the winding core is to be formed. As in the embodiment illustrated in FIGS. 1A-1G and 4, the element 15 rotates about an axis substantially coaxial to the axis A-A of rotation of the winding roller 3. It is not excluded, however, that a different axis of rotation may be provided for the element 15. Said element performs a movement of rotation similar to the one illustrated with reference to FIGS. 1A-1G. The element 13 is not fixed, as in the case of FIGS. 1A-1G, 4. Instead, it is provided with a reciprocating movement in order to be brought alternately into an operative position (indicated by a solid line in FIG. 9) and into a set-back position, which enables passage of the element 15. In the embodiment shown in FIG. 9, this movement is an oscillation movement about an axis X. The oscillation movement is indicated by the double-headed arrow f13. Said movement can be controlled in any suitable way, for example via a cylinder-piston actuator 13X or via a linear electric actuator, or else an actuator which is arranged coaxial to the axis X. In the example shown, a linear actuator is provided, represented schematically as a cylinder-piston actuator 13X, combined to a cam 13Y which, in the example shown, is approximately coaxial to the roller 3. Said cam can be fitted on the axis 19 (FIG. 10), on which the element 15 is supported. Designated by 13Z is a tappet co-operating with the cam 13Y and carried by a supporting arm 13W. In this way, a slow movement of recession and approach via the linear actuator 13X and a fast movement of entry into and exit from the working position are thus obtained.

The configuration shown in FIGS. 9 and 10 enables the elements 13 and 15 to be continuous, without any interruptions, in so far as the element 15 completes its own revolution about the axis A-A, preventing any interference with the element 13, when the latter is brought into the position indicated by a dashed line in FIG. 9. After the element 15 has overcome the position indicated by a dashed line in FIG. 9, the element 13 can be brought gradually into the working position, in which it delimits, i.e. defines with the element 15, the space in which the new core is formed via winding of a length of sheetlike material that can be fed in one of the modes described above.

The diameter of the winding core formed with a device of the type shown in FIGS. 1A-1G, 4 or else 9, 10 is determined by the reciprocal distance (center distance) between the rollers 1, 3, by the geometry of the surfaces 13A, 15A of the elements 13, 15 and by their relative positions.

In the production of rolls of small diameter, for example in the range of 10-20 cm, designed for domestic use, it is usual to form logs of great axial length via winding of a weblike material of a width equal to the width of the starting reel on a winding core of axial length approximately equal to the length of the log. These logs are then cut crosswise.

Conversely, when rolls of large diameter are manufactured, for example beyond 20 cm and up to 30-50 cm (even though said measurements must be understood as indicative and non-limiting or critical), crosswise cutting of the log becomes problematic. There have consequently been produced so-called slitter-rewinder machines, in which the weblike material unwound from a reel of large diameter is divided via longitudinal cuts into individual strips, each of which forms a roll. The winding can occur around cores of length approximately corresponding to the axial length of the rolls, orderly arranged on a supporting spindle, if required.

Figure 12:
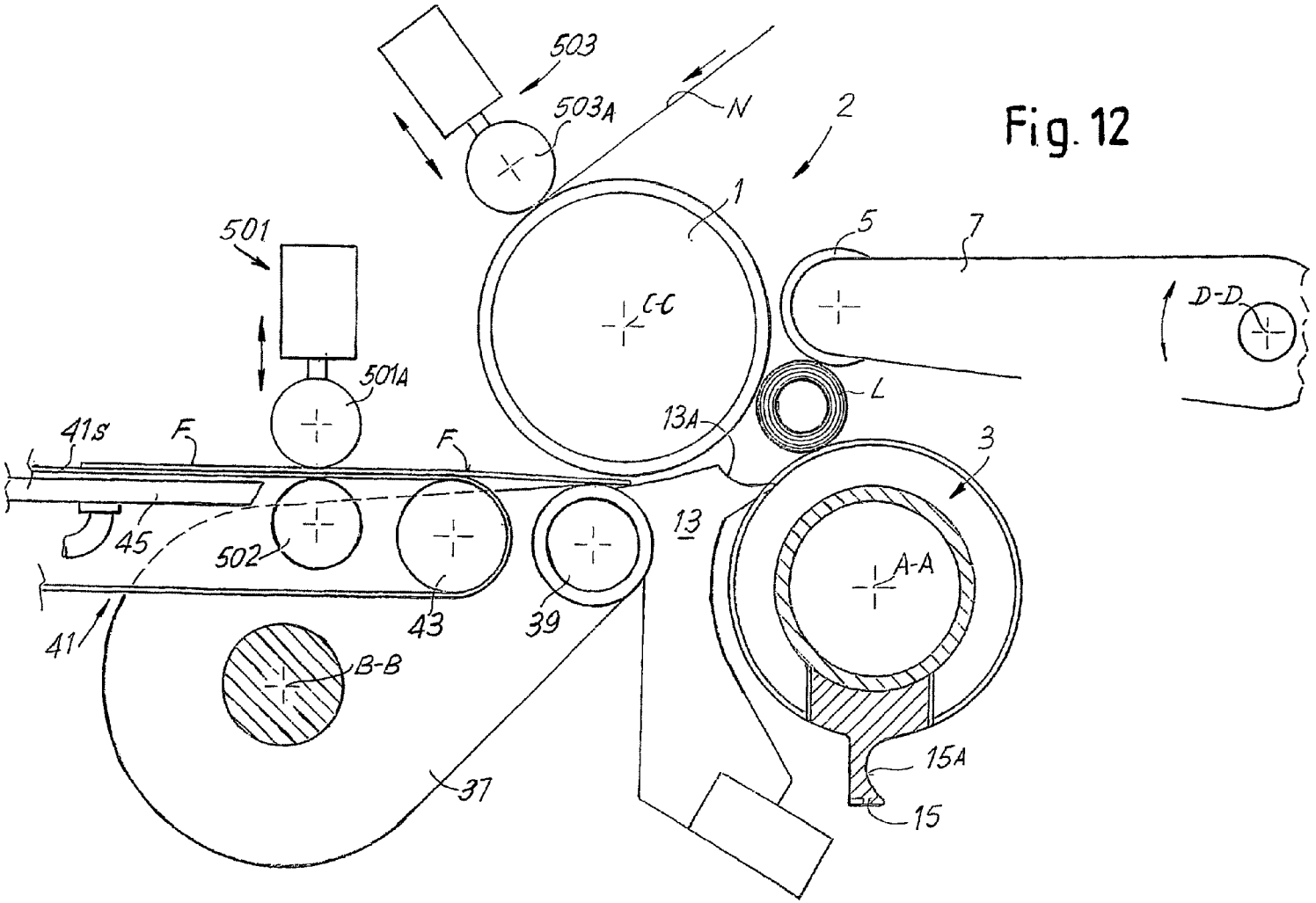
FIGS. 12 and 13 show views similar to those of FIGS. 1A-1G of a different embodiment of the invention.
Figure 13:
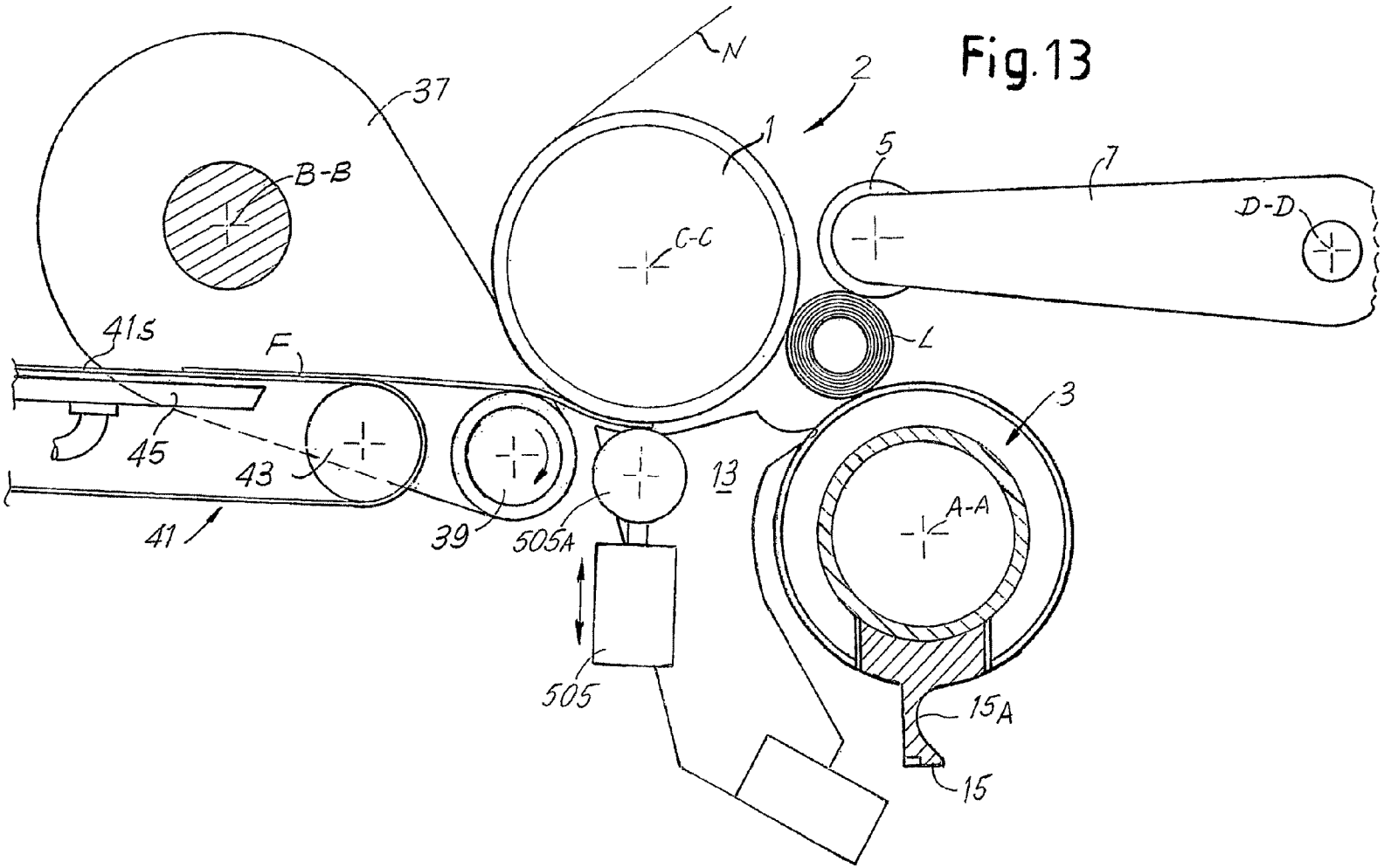

The present invention can be implemented also so as to form rolls in parallel, via division into longitudinal strips of the weblike material coming off the starting reel or reels. Solutions of this type are now described in a synthetic way with reference to FIGS. 11 to 13, where parts that are the same as or correspond to those of the previous figures are designated by the same reference numbers, and consequently will not be described again. More in particular, FIGS. 12 and 13 show a diagram of a machine similar to that of FIGS. 1A-1G, 4. In addition to the elements already described with reference to that preceding embodiment, in this example two cuffing assemblies are provided, designated by 501 and 503, respectively. The assembly 501 can be a perforator assembly, instead of a cutting assembly, for the reasons described hereinafter.

The cutting or perforator assembly 501 comprises a series of disk-shaped blades 501A, co-operating with counter-blades or with a counter-roller, designated as a whole by 502. The blades 501A can be of various types, for example blades that co-operate with edges of the counter-blades or counter-roller 502 to carry out a shearing cut or a shearing perforation. These blades perform longitudinal lines of cutting or of perforation, i.e., in the direction of feed of the weblike material and of the lengths of sheetlike material F, to perforate the sheet F longitudinally or else to cut it into strips.

The cutting assembly 503 comprises disk-shaped blades 503A, co-operating with annular grooves or channels or counter-blades provided in the surface of the winding roller 1. Said cutting assembly 503 divides the weblike material N into individual strips. Each longitudinal strip is wound around a tubular core formed by rolling of the length of sheetlike material F according to what is described with reference to FIGS. 1A-1G, 4.

Figure 11:
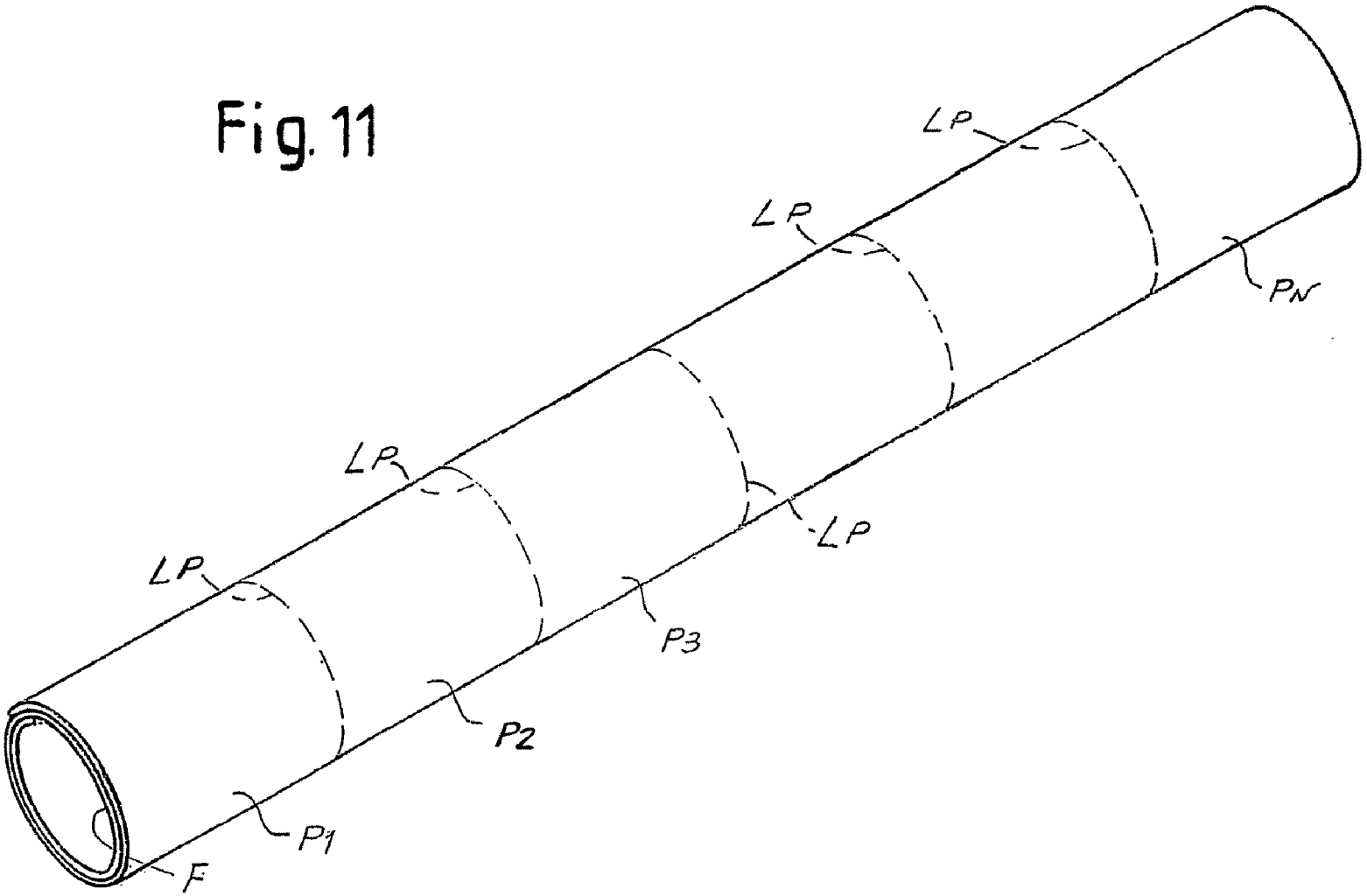
FIG. 11 shows a perspective view of a core obtained from a length of perforated sheetlike material, to form rolls that are to be to separated by severing the winding core along the perforation lines.

If the blades 501A make a perforation and not a cut of the sheet F, this will form a winding core as shown schematically in FIG. 11, provided with annular lines of perforation LP. Defined between adjacent lines of perforation LP is a portion P of tubular core. Wound on each of these portions is a strip of weblike material cut by the disk-shaped blades 503A.

Since the lines generated by the blades 501A are in this case perforation lines and not cutting lines, the sheet F by rolling into the space defined by the concave surfaces 13A, 15A forms a core, which is continuous but is provided with lines of incision and of preferential tearing LP. This simplifies both the formation of the core and its manipulation during the winding step, as compared to a situation in which the sheet F is cut completely into individual lengths, each forming a core of length equal to the length of the portions P.

At the end of winding, logs will thus be obtained, which are formed by a winding core, said winding core being perforated in an annular direction approximately in an area corresponding to the planes of separation of the individual rolls that have been formed thereon by winding the strips generated by the blades 503A. The tubular core can then be easily cut or torn, i.e., separated along the lines of pre-tearing represented by the annular perforations LP.

Shown in FIG. 13 is a modified embodiment, in which parts that are the same or correspond are designated by the same reference numbers as the ones used in FIGS. 1A-1G, 12. In this case, an individual cutting assembly 505 is provided, with disk-shaped blades 505A, equivalent to the blades 503A of the assembly 503, but positioned underneath the winding roller 1, rather than above it. This conformation enables execution of the cut of the length of sheetlike material F and of the weblike material N with the same set of disk-shaped blades 505A. The blades 505A can also be temporarily moved away from the winding roller 1 to prevent execution of the longitudinal cut of the sheet F, of the weblike material N, or of both. In the first case, winding of rolls on a continuous core, which can subsequently be cut, is obtained. In the third case, a continuous log is obtained that can subsequently be cut. A similar movement can be envisaged for the same reasons for the cutting and/or perforation assemblies 501, 503.

Cutting and/or of perforation assemblies similar to the ones described herein can be applied also in the other examples of embodiment.

It is understood that the drawings merely show examples of the invention purely as practical illustration, given that the invention may vary in the forms and arrangements, without thereby departing from the scope of the idea underlying the invention. The possible presence of reference numbers in the annexed claims has the purpose of facilitating reading of the claims, with reference to the description and to the drawings, and in no way limits the scope of the protection represented by the claims.

The invention claimed is:

1. A method for producing rolls of web material wound around winding cores, comprising forming said winding cores by rolling a length of sheet material along a feed path of the web material towards a winding area, and winding said web material around each core to form a roll, wherein said length of sheet material is adhered to the web material and advanced together with said web material along the feed path towards the winding area; and said web material is interrupted after said length of sheet material has been adhered to said web material.

2. The method according to claim 1, including:

a) feeding the web material into the winding area;

b) winding the web material to form a first roll;

c) at end of said winding of said first roll, interrupting the web material to form a final free edge of said first roll and an initial free edge; and d) feeding the length of sheet material towards said winding area and rolling said length to form a winding core for a second roll, to which said initial free edge is associated.

3. The method according to claim 1, wherein said web material is fed in a substantially continuous manner and at a substantially constant rate into said winding area.

4. The method according to claim 1, wherein said web material is interrupted downstream of a point of adhesion between said web material and said length of sheet material.

5. The method according to claim 1, wherein along said feed path, a leading edge of the length of sheet material is deviated towards a core-forming member, by which the length of sheet material is rolled on itself to form said core.

6. The method according to claim 5, wherein said length of sheet material is rolled within a winding core-forming space.

7. The method according to claim 6, wherein said winding core-forming space is formed along the feed path of the web material and adjacent to said web material.

8. The method according to claim 6, including arranging along the feed path of the web material, a plate and a projection which cooperate with one another to define said core-forming space; delimiting said winding core-forming space via said plate and said projection; forming the winding core in said space; and bringing the winding core out of said forming space and moving the winding core towards said winding area.

9. The method according to claim 8, wherein the leading edge of the length of sheet material is deviated towards an inside of said core-forming space by one of said plate or said projection delimiting the core-forming space.

10. The method according to claim 6, including arranging said plate in a fixed position and said projection being mobile so that such cooperate with one another to define said winding core-forming space; bringing said projection into a position in which said projection delimits, with the plate, said winding core-forming space; forming the winding core in said space; bringing the winding core out of said forming space, by moving the projection away from the plate; and moving said core towards said winding area.

11. The method according to claim 6, including arranging a first mobile projection and a second mobile projection so that such cooperate with one another to define said winding core-forming space; bringing said first mobile projection and said second mobile projection into a position in which said first mobile projection and said second mobile projection delimit said winding core-forming space; forming the winding core in said space, bringing the winding core out of said forming space, moving said first mobile projection and said second mobile projection away from one another; and moving said core towards said winding area.

12. The method according to claim 1, wherein said length of sheet material and said web material are pressed against a feed member, over which the web material is run.

13. The method according to claim 1, wherein said length of sheet material and said web material are adhered together before completing formation of the winding core.

14. The method according to claim 13, wherein said length of sheet material is adhered to the web material before starting the winding of the length of sheet material, in a proximity of a front edge of said length of sheet material.

15. The method according to claim 1, wherein said sheet material is a paper material having a mass per unit area comprising between 50 and 400 g/m$^2$.

16. The method according to claim 1, wherein the web material is interrupted at an end of the winding of a roll and the length of sheet material is rolled to form the winding core of a subsequent roll via a mobile projection that pinches the web material against a feed member over which said web material is run, speed of the mobile projection during contact with the web material being lower than a rate of feed of the web material.

17. The method according to claim 16, wherein said mobile projection cooperates with a plate in a fixed position to form a winding core-forming space.

18. The method according to claim 16, wherein said mobile projection rotates about an axis of rotation coinciding with an axis of rotation of a winding roller.

19. The method according to claim 1, wherein said web material is wound via a surface winding system.

20. The method according to claim 1, wherein said web material is cut longitudinally into longitudinal strips and, with each of said longitudinal strips, a respective roll is formed, said strips being wound simultaneously to form a plurality of rolls.

21. The method according to claim 20, wherein said sheet material is perforated in order to divide said sheet material into a plurality of portions which are joined together, each portion corresponding to one of said rolls, and wherein said strips are wound on a winding core formed by said sheet material, said core having tearing lines between one roll and an adjacent roll.

22. The method according to claim 20, wherein said sheet material is cut into longitudinal portions, to form individual winding cores, around each of which one of said longitudinal strips is wound, to form a respective roll.

23. The method according to claim 1, wherein said sheet material that forms the winding cores is made of paper that is dissolvable in a sanitary system.

24. The method according to claim 1, wherein said sheet material is made of paper substantially devoid of moisture-resistant resins.

25. The method according to claim 1, wherein said sheet material is made of water-soluble paper.

26. A rewinding machine for producing rolls of web material around winding cores, comprising a path for feeding the web material towards a winding area in which said web material is wound in rolls, a feeder for feeding a sheet material towards the path of the web material, core-forming members for rolling a length of said sheet material and forming therewith a winding core around which a roll of the web material is formed; and a device to cause the length of sheet material to adhere to the web material before interrupting said web material at an end of winding of a roll.

27. The machine according to claim 26, wherein said core-forming members are arranged along the path of the web material.

28. The machine according to claim 26, wherein said core-forming members are arranged upstream of said winding area.

29. The machine according to claim 26, wherein said feeder comprises a rotating roller.

30. The machine according to claim 29, wherein said rotating roller is positioned in front of a mobile projection over which the web material is run, the path of the web material extending between said rotating roller and said mobile projection.

31. The machine according to claim 30, wherein said rotating roller is mobile to move up to the web material and pinch the sheet material against the web material run over said mobile member.

32. The machine according to claim 29, wherein said rotating roller is maintained constantly in rotation at a peripheral velocity substantially equal to a rate of feed of the web material.

33. The machine according to claim 26, wherein said feeder comprises means for temporary retention of the sheet material.

34. The machine according to claim 26, further comprising a glue dispenser.

35. The machine according to claim 34, wherein said glue dispenser is constructed and arranged to apply glue to the length of sheet material.

36. The machine according to claim 26, wherein said core-forming members comprise means for deviating a leading part of the length of sheet material along a rolling path.

37. The machine according to claim 26, wherein said core-forming members comprise a space for formation of a winding core, within which said length of sheet material is inserted and rolled and from which a rolled sheet material comes out to advance towards said winding area with the web material that winds around the rolled sheet material.

38. The machine according to claim 37, further comprising mutually mobile structural members constructed and arranged to define said winding space, which are controlled for being moved away from one another in order to feed the rolled sheet material towards said winding area.

39. The machine according to claim 38, wherein one of said fixed plate and said projection also is constructed and arranged to interrupt the web material at an end of winding of each roll.

40. The machine according to claim 39, wherein said projection rotates about an axis of rotation and wherein said fixed plate and said projection are constructed and arranged to delimit said formation space, the projection is located downstream of the fixed plate with respect to a direction of feed of the web material.

41. The machine according to claim 40, wherein said projection co-operates with a mobile winding member over which the web material is run, said projection pinching the web material against the winding member and advancing at a rate lower than that of the winding member to cause interruption of the web material.

42. The machine according to claim 37, wherein said formation space is defined by a first projection and by a second projection, which are mobile with respect to one another and have opposed concave surfaces delimiting said formation space.

43. The machine according to claim 42, wherein said fixed plate rotates or oscillates about an axis of rotation.

44. The machine according to claim 43, wherein said axis of rotation of at least one of said fixed plate and said projection coincides with an axis of rotation of a winding roller of a surface winding cradle for formation of said rolls.

45. The machine according to claim 42, wherein said projection rotates or oscillates about an axis of rotation.

46. The machine according to claim 37, wherein said formation space is defined by a fixed plate and by a projection which is mobile with respect to the fixed plate, said fixed plate and said projection having opposed concave surfaces delimiting said formation space.

47. The machine according to claim 37, wherein said formation space is defined adjacent to a mobile projection over which the web material is run and is positioned and made to receive an initial edge of the length of sheet material fed with said web material.

48. The machine according to claim 26, further comprising cutting members that divide said web material into strips, each strip forming a respective roll.

49. The machine according to claim 48, including perforating members that divide via lines of perforation said sheet material into individual portions, each portion being associated to a respective one of said strips.

50. The machine according to claim 48, including cutting members that divide the sheet material into individual separate portions, each portion being associated to a respective one of said strips.

* * * * *